United States Patent [19]

Ripple et al.

[11] Patent Number: 4,981,602

[45] **Date of Patent: * Jan. 1, 1991**

[54] LUBRICATING OIL COMPOSITIONS AND CONCENTRATES

[75] Inventors: David E. Ripple, Kirtland; Calvin W. Schroeck, Eastlake, both of Ohio

[73] Assignee: The Lubrizol Corporation, Wickliffe, Ohio

[ * ] Notice: The portion of the term of this patent subsequent to Feb. 27, 2007 has been disclaimed.

[21] Appl. No.: 206,113

[22] Filed: Jun. 13, 1988

[51] Int. Cl.[5] ..... C10M 137/06; C10M 141/06

[52] U.S. Cl. ..... 252/32.7 E; 252/33.3; 252/51.5 A; 252/56 R; 252/33.4

[58] Field of Search ..... 252/32.7 E, 33, 56 R, 252/51.5 A, 40, 33.4, 39, 33.3

[56] References Cited

U.S. PATENT DOCUMENTS

| | | | |
|---|---|---|---|
| Re. 26,330 | 1/1968 | Colfer . | |
| Re. 27,331 | 4/1972 | Coleman . | |
| 2,875,221 | 2/1959 | Birnbaum . | |
| 2,911,367 | 11/1959 | Baus et al. | 252/32.7 |
| 3,172,892 | 3/1965 | Le Suer et al. . | |
| 3,215,707 | 11/1965 | Rense . | |
| 3,219,666 | 11/1965 | Norman et al. . | |

(List continued on next page.)

FOREIGN PATENT DOCUMENTS

| | | |
|---|---|---|
| 092946 | 11/1983 | European Pat. Off. . |
| 294096 | 12/1988 | European Pat. Off. . |
| 0311319 | 4/1989 | European Pat. Off. . |
| 317348 | 5/1989 | European Pat. Off. . |
| 317354 | 5/1989 | European Pat. Off. . |
| 1233858 | 5/1960 | France . |
| WO87/01722 | 3/1987 | PCT Int'l Appl. . |
| WO87/04454 | 9/1987 | PCT Int'l Appl. . |
| 1039961 | 8/1966 | United Kingdom . |
| 1274647 | 5/1972 | United Kingdom . |
| 1440219 | 9/1973 | United Kingdom . |
| 1424977 | 2/1976 | United Kingdom . |
| 1485155 | 9/1977 | United Kingdom . |
| 1511503 | 5/1978 | United Kingdom . |
| 1548464 | 7/1979 | United Kingdom . |
| 2062672A | 5/1981 | United Kingdom . |
| 2078757A | 1/1982 | United Kingdom . |
| 2102023A | 1/1983 | United Kingdom . |

OTHER PUBLICATIONS

WO87/01722 PCT Published Application the Lubrizol Corporation, Ripple, David E. 3/26/87.

0208560 European Application Publication Exxon Chemical Patents Inc., 5/15/87.

*Primary Examiner*—Jacqueline V. Howard

*Attorney, Agent, or Firm*—Joseph P. Fischer; Frederick D. Hunter; James L. Cordek

[57] ABSTRACT

Lubricating oil compositions for internal combustion engines are described which comprise (A) a major amount of oil of lubricating viscosity, and minor amounts of (B) at least one carboxylic derivative composition produced by reacting (B-1) at least one substituted succinic acylating agent with (B-2) from about 0.70 equivalent up to less than one equivalent, per equivalent of acylating agent, of at least one amine compound characterized by the presence within its structure of at least one HN< group, said acylating agents being characterized by the presence within their structure of an average of at least 1.3 succinic groups for each equivalent weight of substituent groups, and (C) at least one metal salt of a dihydrocarbyl dithiophosphoric acid wherein (C-1) the dithiophosphoric acid is prepared by reacting phosphorus pentasulfide with an alcohol mixture comprising at least 10 mole percent of iopropyl alcohol and at least one primary aliphatic alcohol containing from about 3 to about 13 carbon atoms, and (C-2) the metal is a Group II metal, aluminum, tin, iron, cobalt, lead, molybdenum, manganese, nickel or copper.

105 Claims, 1 Drawing Sheet

OTHER PUBLICATIONS 3,231,587 1/1966 Rense .
3,235,484 2/1966 Colfer .
3,235,498 2/1966 Waldmann .
3,272,746 9/1966 Le Suer et al. .
3,372,116 2/1968 Meinhardt .
3,385,791 5/1968 Colyer et al. ..... 252/32.7
3,410,798 11/1968 Cohen .
3,522,179 7/1970 Le Suer .
3,562,159 2/1971 Mastin .
3,576,743 4/1971 Widmer et al. .
3,632,510 1/1972 Le Suer .
3,804,763 4/1974 Meinhardt .
3,912,764 10/1975 Palmer, Jr. .
3,920,562 11/1975 Foehr .
3,933,659 1/1976 Lyle et al. ..... 252/32.7 E
3,948,800 4/1976 Meinhardt .
3,957,854 5/1976 Miller .
4,010,106 3/1977 Rathert ..... 252/32.7 E
4,105,571 8/1978 Shaub et al. ..... 252/32.7 E
4,110,349 8/1978 Cohen .
4,113,639 9/1978 Lonstrup et al. .
4,119,549 10/1978 Davis .
4,234,435 11/1980 Meinhardt et al. ..... 252/51.5 A
4,263,150 4/1988 Clason et al. .
4,289,635 9/1981 Schroeck .
4,304,678 12/1981 Schick et al. .
4,308,154 12/1981 Clason et al. .
4,417,990 11/1983 Clason et al. .
4,455,243 6/1984 Liston ..... 252/49.6
4,466,895 8/1984 Schroeck .
4,505,830 3/1985 Uinci .
4,683,069 7/1987 Brewster et al. ..... 252/32.7 E

LUBRICATING OIL COMPOSITIONS AND CONCENTRATES

FIELD OF THE INVENTION

This invention relates to lubricating oil compositions. In particular, this invention relates to lubricating oil compositions comprising an oil of lubricating viscosity, a carboxylic derivative composition exhibiting both VI and dispersant properties, and at least one metal salt of a dihydrocarbyl dithiophosphoric acid.

BACKGROUND OF THE INVENTION

Lubricating oils which are utilized in internal combustion engines, and in particular, in spark-ignited and diesel engines are constantly being modified and improved to provide improved performance. Various organizations including the SAE (Society of Automotive Engineers), the ASTM (formerly the American Society for Testing and Materials) and the API (American Petroleum Institute) as well as the automotive manufacturers continually seek to improve the performance of lubricating oils. Various standards have been established and modified over the years through the efforts of these organizations. As engines have increased in power output and complexity, the performance requirements have been increased to provide lubricating oils that will exhibit a reduced tendency to deteriorate under conditions of use and thereby to reduce wear and the formation of such undesirable deposits as varnish, sludge, carbonaceous materials and resinous materials which tend to adhere to the various engine parts and reduce the efficiency of the engines.

In general, different classifications of oils and performance requirements have been established for crankcase lubricants to be used in spark-ignited engines and diesel engines because of the differences in/and the demands placed on, lubricating oils in these applications. Commercially available quality oils designed for spark-ignition engines have been identified and labeled in recent years as "SF" oils, when the oils are capable of satisfying the performance requirements of API Service Classification SF. A new API Service Classification SG has recently been established, and this oil is to be labeled "SG". The oils designated as "SG" must pass the performance requirements of API Service Classification SG which have been established to insure that these new oils will possess additional desirable properties and performance capabilities in excess of those required for SF oils. The SG oils are to be designed to minimize engine wear and deposits and also to minimize thickening in service. The SG oils are intended to improve engine performance and durability when compared to all previous engine oils marketed for spark-ignition engines. An added feature of SG oils is the incorporation of the requirements of the CC category (diesel) into the SG specification.

In order to meet the performance requirements of SG oils, the oils must successfully pass the following gasoline and diesel engine tests which have been established as standards in the industry: The Ford Sequence VE Test; The Buick Sequence IIIE Test; The Oldsmobile Sequence IID Test; The CRC L-38 Test; and The Caterpillar Single Cylinder Test Engine 1H2. The Caterpillar Test is included in the performance requirements in order to also qualify the oil for the light duty diesel use (diesel performance catetory "CC"). If it is desired to have the SG classification oil also qualify for heavy-duty diesel use, (diesel category "CD") the oil formulation must pass the more rigorous performance requirements of the Caterpillar Single Cylinder Test Engine 1G2. The requirements for all of these tests have been established by the industry, and the tests are described in more detail below.

When it is desired that the lubricating oils of the SG classification also exhibit improved fuel economy, the oil must also meet the requirements of the Sequence VI Fuel Efficient Engine Oil Dynamometer Test.

A new classification of diesel engine oil also has been established through the joint efforts of the SAE, ASTM and the API, and the new diesel oils will be labeled "CE". The oils meeting the new diesel classification CE will have to be capable of meeting additional performance requirements not found in the present CD category including the Mack T-6, Mack T-7, and the Cummins NTC-400 Tests.

An ideal lubricant for most purposes should possess the same viscosity at all temperatures. Available lubricants, however, depart from this ideal. Materials which have been added to lubricants to minimize the viscosity change with temperature are called viscosity modifiers, viscosity improvers, viscosity index improvers or VI improvers. In general, the materials which improve the VI characteristics of lubricating oils are oil soluble organic polymers, and these polymers include polyisobutylenes, polymethacrylates (i.e., copolymers of various chain length alkyl methacrylates); copolymers of ethylene and propylene; hydrogenated block copolymers of styrene and isoprene; and polyacrylates (i.e., copolymers of various chain length alkyl acrylates).

Other materials have been included in the lubricating oil compositions to enable the oil compositions to meet the various performance requirements, and these include, dispersants, detergents, friction-modifiers, corrosion-inhibitors, etc. Dispersants are employed in lubricants to maintain impurities, particularly those formed during operation of an internal combustion engine, in suspension rather than allowing them to deposit as sludge. Materials have been described in the prior art which exhibit both viscosity-improving and dispersant properties. One type of compound having both properties is comprised of a polymer backbone onto which backbone has been attached one or more monomers having polar groups. Such compounds are frequently prepared by a grafting operation wherein the backbone polymer is reacted directly with a suitable monomer.

Dispersant additives for lubricants comprising the reaction products of hydroxy compounds or amines with substituted succinic acids or their derivatives also have been described in the prior art, and typical dispersants of this type are disclosed in, for example, U.S. Pat. Nos. 3,272,746; 3,522,179; 3,219,666; and 4,234,435. When incorporated into lubricating oils, the compositions described in the '435 patent function primarily as dispersants/detergents and viscosity index improvers.

SUMMARY OF THE INVENTION

A lubricating oil formulation is described which is useful in internal combustion engines. More particularly, lubricating oil compositions for internal combustion engines are described with comprise (A) a major amount of oil of lubricating viscosity, and a minor amount of (B) at least one carboxylic derivative composition produced by reacting (B-1) at least one substituted succinic acylating agent with from about 0.70 equivalent up to less than one equivalent, per equivalent of acylating agent, of (B-2) at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) at least one metal salt of a dihydrocarbyl dithiophosphoric acid wherein (C-1) the dithiophosphoric acid is prepared by reacting phosphorus pentasulfide with an alcohol mixture comprising at least 10 mole percent of isopropyl alcohol and at least one primary aliphatic alcohol containing from about 3 to about 13 carbon atoms, and (C-2) the metal is a Group II metal, aluminum, tin, iron, cobalt, lead, molybdenum, manganese, nickel or copper. The oil compositions of the invention may also contain (D) at least one carboxylic ester derivative composition, and/or (E) at least one neutral or basic alkaline earth metal salt of at least one acidic organic compound, and/or (F) at least one partial fatty acid ester of a polyhydric alcohol. In one embodiment, the oil compositions of the present invention contain the above additives and other additives described in this application in an amount sufficient to enable the oil to meet all the performance requirements of either or both the new API Service Classifications identified as "SG" and "CE".

DESCRIPTION OF THE PREFERRED EMBODIMENTS

Figure 1:
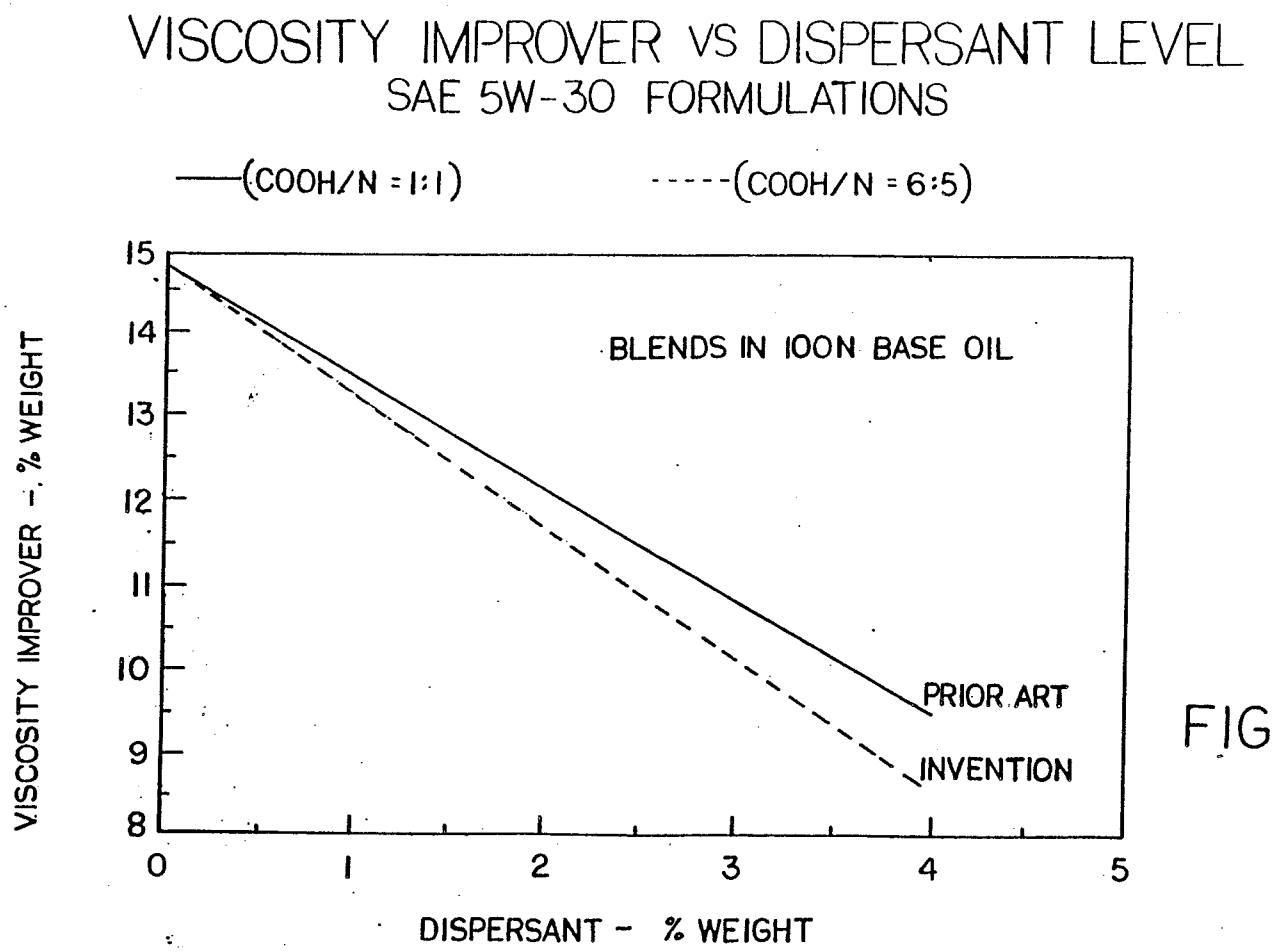
FIG. 1 is a graph illustrating the relationship of concentration of two dispersants and a polymeric viscosity improver required to maintain a given viscosity.

The lubricating oil compositions of the present invention comprise, in one embodiment, (A) a major amount of oil of lubricating viscosity, and minor amounts of (B) at least one carboxylic derivative composition produced by reacting (B-1) at least one substituted succinic acylating agent with from about 0.70 up to less than one equivalent, per equivalent of acylating agent, of (B-2) at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) at least one metal salt of a dihydrocarbyl dithiophosphoric acid wherein (C-1) the dithiophosphoric acid is prepared by reacting phosphorus pentasulfide with an alcohol mixture comprising at least 10 mole percent of isopropyl alcohol and at least one primary aliphatic alcohol containing from about 3 to about 13 carbon atoms, and (C-2) the metal is a Group II metal, aluminum, tin, iron, cobalt, lead, molybdenum, manganese, nickel or copper.

Throughout this specification and claims, references to percentages by weight of the various components, except for component (A) which is oil, are on a chemical basis unless otherwise indicated. For example, when the oil compositions of the invention are described as containing at least 2% by weight of (B), the oil composition comprises at least 2.0% by weight of (B) on a chemical basis. Thus, if component (B) is available as a 50% by weight oil solution, at least 4% by weight of the oil solution would be included in the oil composition.

The number of equivalents of the acylating agent depends on the total number of carboxylic functions present. In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of an amine or a polyamine is the molecular weight of the amine or polyamine divided by the total number of nitrogens present in the molecule. Thus, ethylene diamine has an equivalent weight equal to one-half of its molecular weight; diethylene triamine has an equivalent weight equal to one-third its molecular weight. The equivalent weight of a commercially available mixture of polyalkylene polyamine can be determined by dividing the atomic weight of nitrogen (14) by the % N contained in the polyamine and multiplying by 100; thus, a polyamine mixture containing 34% N would have an equivalent weight of 41.2. An equivalent weight of ammonia or a monoamine is the molecular weight.

An equivalent weight of a hydroxyl-substituted amine to be reacted with the acylating agents to form the carboxylic derivative (B) is its molecular weight divided by the total number of nitrogen groups present in the molecule. For the purpose of this invention in preparing component (B), the hydroxyl groups are ignored when calculating equivalent weight. Thus, ethanolamine would have an equivalent weight equal to its molecular weight, and diethanolamine was an equivalent weight (nitrogen base) equal to its molecular weight.

The equivalent weight of a hydroxyl-substituted amine used to form the carboxylic ester derivatives (D) useful in this invention is its molecular weight divided by the number of hydroxyl groups present, and the nitrogen atoms present are ignored. Thus, when preparing esters from, e.g., diethanolamine, the equivalent weight is one-half the molecular weight of diethanolamine.

The terms "substituent" and "acylating agent" or "substituted succinic acylating agent" are to be given their normal meanings. For example, a substituent is an atom or group of atoms that has replaced another atom or group in a molecule as a result of a reaction. The term acylating agent or substituted succinic acylating agent refers to the compound per se and does not include unreacted reactants used to form the acylating agent or substituted succinic acylating agent.

(A) Oil of Lubricating Viscosity.

The oil which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl(4-methyl-2-pentoxy)-disiloxane, poly(methyl)siloxanes, poly(methylphenyl)-siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterificatien process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled, or reprocessed oils and often are additionally processed by techniques directed to removal of spent additives and oil breakdown products.

(B) Carboxylic Derivatives.

Component (B) which is utilized in the lubricating oils of the present invention is at least one carboxylic derivative composition produced by reacting (B-1) at least one substituted succinic acylating agent with (B-2) from about 0.70 equivalent up to less than one equivalent, per equivalent of acylating agent, of at least one amine compound containing at least one HN< group, and wherein said acylating agent consists of substituent groups and succinic groups wherein the substituent groups are derived from a polyalkene characterized by an $\overline{M}n$ value of about 1300 to about 5000 and an $\overline{M}w/\overline{M}n$ ratio of about 1.5 to about 4.5, said acylating agents being characterized by the presence within their structure of an average of at least 1.3 succinic groups for each equivalent weight of substituent groups.

The substituted succinic acylating agent (B-1) utilized the preparation of the carboxylic derivative (B) can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an $\overline{M}n$ value of from about 1300 to about 5000, and an $\overline{M}w/\overline{M}n$ value of at least about 1.5 and more generally from about 1.5 to about 4.5 or about 1.5 to about 4.0. The abbreviation $\overline{M}w$ is the conventional symbol representing weight average molecular weight, and $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

The second group or moiety in the acylating agent is referred to herein as the "succinic group(s)". The succinic groups are those groups characterized by the structure

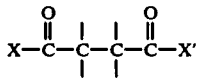

(I)

wherein X and X' are the same or different provided at least one of X and X' is such that the substituted succinic acylating agent can function as carboxylic acylating agents. That is, at least one of X and X' must be such that the substituted acylating agent can form amides or amine salts with amino compounds, and otherwise function as a conventional carboxylic acid acylating agents. Transesterification and transamidation reactions are considered, for purposes of this invention, as conventional acylating reactions.

Thus, X and/or X' is usually —OH, —O—hydrocarbyl, —O—M+ where M+ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

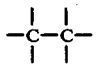

of Formula I forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The substituted succinic acylating agents are characterized by the presence within their structure of an average of at least 1.3 succinic groups (that is, groups corresponding to Formula I) for each equivalent weight of substituent groups. For purposes of this invention, the equivalent weight of substituent groups is deemed to be the number obtained by dividing the $\overline{M}n$ value of the polyalkene from which the substituent is derived into the total weight of the substituent groups present in the substituted succinic acylating agents. Thus, if a substituted succinic acylating agent is characterized by a total weight of substituent group of 40,000, and the $\overline{M}n$ value for the polyalkene from which the substituent groups are derived is 2000, then that substituted succinic acylating agent is characterized by a total of 20 (40,000/2000=20) equivalent weights of substituent groups. Therefore, that particular succinic acylating agent or succinic acylating agent mixture must also be characterized by the presence within its structure of at least 26 succinic groups to meet one of the requirements of the succinic acylating agents used in this invention.

Another requirement for the substituted succinic acylating agents is that the substituent groups must have been derived from a polyalkene characterized by an $\overline{M}w/\overline{M}n$ value of at least about 1.5. The upper limit of $\overline{M}w/\overline{M}n$ will generally be about 4.5. Values of from 1.5 to about 4.0 are particularly useful.

Polyalkenes having the $\overline{M}n$ and $\overline{M}w$ values discussed above are known in the art and can be prepared according to conventional procedures. For example, some of these polyalkenes are described and exemplified in U.S. Pat. No. 4,234,435, and the disclosure of this patent relative to such polyalkenes is hereby incorporated by reference. Several such polyalkenes, especially polybutenes, are commercially available.

In one preferred embodiment, the succinic groups will normally correspond to the formula

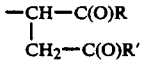

(II)

wherein R and R' are each independently selected from the group consisting of —OH, —Cl, —O—lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

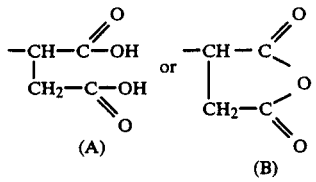

(III)

and mixtures of (III(A)) and (III(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group in the substituted succinic acylating agent is 1.3. The maximum number generally will not exceed about 4. Generally the minimum will be about 1.4 succinic groups for each equivalent weight of substituent group. A narrower range based on this minimum is at least about 1.4 to about 3.5, and more specifically about 1.4 to about 2.5 succinic groups per equivalent weight of substituent groups.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of $\overline{M}n$ for example, a minimum of about 1300 and a maximum of about 5000 are preferred with an $\overline{M}n$ value in the range of from about 1500 to about 5000 also being preferred. A more preferred $\overline{M}n$ value is one in the range of from about 1500 to about 2800. A most preferred range of $\overline{M}n$ values is from about 1500 to about 2400.

Before proceeding to a further discussion of the polyalkenes from which the substituent groups are derived, it should be pointed out that these preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of $\overline{M}n$ or $\overline{M}w/\overline{M}n$. They are intended to be dependent in the sense that, for example, when a preference for a minimum of 1.4 or 1.5 succinic groups is combined with more preferred values of $\overline{M}n$ and/or $\overline{M}w/\overline{M}n$, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

In one embodiment, when the $\overline{M}n$ of a polyalkene is at the lower end of the range, e.g., about 1300, the ratio of succinic groups to substituent groups derived from said polyalkene in the acylating agent is preferably higher than the ratio when the $\overline{M}n$ is, for example, 1500. Conversely when the $\overline{M}n$ of the polyalkene is higher, e.g., 2000, the ratio may be lower than when the Mn of the polyalkene is, e.g., 1500.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., $>C=C<$); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C=CH_2$. However, polymerizable internal olefin monomers (sometimes referred to in the literature as medial olefins) characterized by the presence within their structure of the group

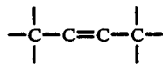

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

Some of the substituted succinic acylating agents (B-1) useful in preparing the carboxylic derivatives (B) and methods for preparing such substituted succinic acylating agents are known in the art and are described in, for example, U.S. Pat. No. 4,234,435, the disclosure of which is hereby incorporated by reference. The acylating agents described in the '435 patent are characterized as containing substituent groups derived from polyalkenes having ar $\overline{M}n$ value of about 1300 to about 5000, and an $\overline{M}w/\overline{M}n$ value of about 1.5 to about 4. In addition to the acylating agents described in the '435 patent, the acylating agents (B-1) useful in the present invention may contain substituent groups derived from polyalkenes having an $\overline{M}w/\overline{M}n$ ratio of up to about 4.5.

While the polyalkenes from which the substituent groups of the succinic acylating agents are derived generally are hydrocarbon groups, they can contain nonhydrocarbon substituents such as lower alkoxy, lower alkyl mercapto, hydroxy, mercapto, nitro, halo, cyano, carboalkoxy, (where alkoxy is usually lower alkoxy), alkanoyloxy, and the like provided the nonhydrocarbon substituents do not substantially interfere with formation of the substituted succinic acid acylating agents of this invention. When present, such non-hydrocarbon groups normally will not contribute more than about 10% by weight of the total weight of the polyalkenes. Since the polyalkene can contain such nonhydrocarbon substituents, it is apparent that the olefin monomers from which the polyalkenes are made can also contain such substituents. Normally, however, as a matter of practicality and expense, the olefin monomers and the polyalkenes will be free from non-hydrocarbon groups, except chloro groups which usually facilitate the formation of the substituted succinic acylating agents of this invention. (As used herein, the term "lower" when used with a chemical group such as in "lower alkyl" or "lower alkoxy" is intended to describe groups having up to 7 carbon atoms).

Although the polyalkenes may include aromatic groups (especially phenyl groups and lower alkyl- and/or lower alkoxy-substituted phenyl groups such as para-(tert-butyl)phenyl) and cycloaliphatic groups such as would be obtained from polymerizable cyclic olefins or cycloaliphatic substituted-polymerizable acyclic olefins, the polyalkenes usually will be free from such groups. Nevertheless, polyalkenes derived from interpolymers of both 1,3-dienes and styrenes such as butadiene-1,3 and styrene or para-(tert-butyl)styrene are exceptions to this generalization. Again, because aromatic and cycloaliphatic groups can be present, the olefin monomers from which the polyalkenes are prepared can contain aromatic and cycloaliphatic groups.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymer and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene; propylene; butene-1; butene-2; isobutene; pentene-1; hexene-1; heptene-1; octene-1; nonene-1; decene-1; pentene-2; propylene-tetramer; diisobutylene; isobutylene trimer; butadiene-1,2; butadiene-1,3; pentadiene-1,2; pentadiene-1,3; pentadiene-1,4; isoprene; hexadiene-1,5; 2-chloro-butadiene1,3; 2-methyl-heptene-1; 3-cyclohexylbutene-1; 2-methyl-pentene-1; styrene; 2,4-dichloro styrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-butadiene-1,3 copolymers, propene-isoprene copolymers, isobutene-chloroprene copolymers, isobutene-(paramethyl)styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-dimethyl-pentene-1 with hexene-1, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35 to about 75% by weight and an isobutene content of about 30 to about 60% by weight in the presence of a Lewis acid catalyst such as aluminum trichloride or boron trifluoride. These polybutenes contain predominantly (greater than about 80% of the total repeating units) of isobutene (or isobutylene) repeating units of the configuration

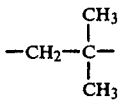

Obviously, preparing polyalkenes as described above which meet the various criteria for Mn and Mw/Mn is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents (B-1), one or more of the above-described polyalkenes is reacted with one or more acidic reactants selected from the group consisting of maleic or fumaric reactants of the general formula

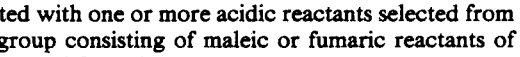

$$X(O)C—CH{=}CH—C(O)X' \quad (IV)$$

wherein X and X' are as defined hereinbefore in Formula I. Preferably the maleic and fumaric reactants will be one or more compounds corresponding to the formula

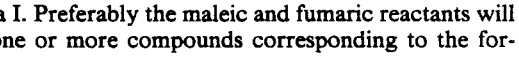

$$RC(O)—CH{=}CH—C(O)R' \quad (V)$$

wherein R and R' are as previously defined in Formula II herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The one or more polyalkenes and one or more maleic or fumaric reactants can be reacted according to any of several known procedures in order to produce the substituted succinic acylating agents of the present invention. Basically, the procedures are analogous to procedures used to prepare the higher molecular weight succinic anhydrides and other equivalent succinic acylating analogs thereof except that the polyalkenes (or polyolefins) of the prior art are replaced with the particular polyalkenes described above and the amount of maleic or fumaric reactant used must be such that there is an average of at least 1.3 succinic groups for each equivalent weight of the substituent group in the final substituted succinic acylating agent produced. Examples of patents describing various procedures by preparing acylating agents include U.S. Pat. No. 3,215,707 (Rense); U.S. Pat. No. 3,219,666 (Norman et al); U.S. Pat. No. 3,231,587 (Rense); U.S. Pat. No. 3,912,764 (Palmer); U.S. Pat. No. 4,110,349 (Cohen); and U.S. Pat. No. 4,234,435 (Meinhardt et al); and U.K. No. 1,440,219. The disclosures of these patents are hereby incorporated by reference.

For convenience and brevity, the term "maleic reactant" is often used hereinafter. When used, it should be understood that the term is generic to acidic reactants selected from maleic and fumaric reactants corresponding to Formulae (IV) and (V) above including a mixture of such reactants.

One procedure for preparing the substituted succinic acylating agents (B-1) is illustrated, in part, in U.S. Pat. No. 3,219,666 (Norman et al) which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the $\overline{M}n$ value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure is to react the chlorinated polyalkene with the maleic reactant at a temperature usually within the range of about 100° C. to about 200° C. The mole ratio of chlorinated polyalkene to maleic reactant is usually at least about 1:1.3. (In this application, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. More than one mole of maleic reactant may react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the $\overline{M}n$ value divided by the average number of chloro groups per molecule of chlorinated polyalkene while the equivalent weight of a maleic reactant is its molecular weight.) Thus, the ratio of chlorinated polyalkene to maleic reactant will normally be such as to provide at least about 1.3 equivalents of maleic reactant for each mole of chlorinated polyalkene. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing the substituted succinic acid acylating agents useful in the invention utilizes a process described in U.S. Pat. No. 3,912,764 (Palmer) and U.K. Patent No. 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed. In utilizing this process to prepare the substituted succinic acylating agents, it is necessary to use sufficient maleic reactant and chlorine to incorporate at least 1.3 succinic groups into the final product, i.e., the substituted succinic acylating agent, for each equivalent weight of polyalkene, i.e., reacted polyalkenyl in final product.

Other processes for preparing the acylating agents (B-1) are also described in the prior art. U.S. Pat. No. 4,110,349 (Cohen) describes a two-step process. The disclosure of U.S. Pat. No. 4,110,349 relating to the two-step process is hereby incorporated by reference.

The process presently deemed to be best for preparing the substituted succinic acylating agents (B-1) from the standpoint of efficiency, overall economy, and the performance of the acylating agents thus produced, as well as the performance of the derivatives thereof, is the so-called "one-step" process. This process is described in U.S. Pat. No. 3,215,707 (Rense) and U.S. Pat. No. 3,231,587 (Rense). Both are expressly incorporated herein by reference for their teachings in regard to that process.

Basically, the one-step process involves preparing a mixture of the polyalkene and the maleic reactant containing the necessary amounts of both to provide the desired substituted succinic acylating agents. This means that there must be at least 1.3 moles of maleic reactant for each mole of polyalkene in order that there can be at least 1.3 succinic groups for each equivalent weight of substituent groups. Chlorine is then introduced into the mixture, usualy by passing chlorine gas through the mixture with agitation, while maintaining a temperature of at least about 140° C.

A variation on this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and per-chlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine and maleic reactant so as to maximize reactant utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200° C. to about 210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

As mentioned previously, the molar ratio of polyalkene to maleic reactant is such that there are at least about 1.3 moles of maleic reactant for each mole of polyalkene. This is necessary in order that there can be at least 1.3 succinic groups per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

A preferred process for preparing the substituted acylating agents comprises heating and contacting at a temperature of at least about 140° C. up to the decomposition temperature, (A) Polyalkene characterized by $\overline{M}n$ value of about 1300 to about 5000 and an $\overline{M}w/\overline{M}n$ value of about 1.5 to about 6, (B) One or more acidic reactants of the formula $$XC(O)—CH=CH—C(O)X'$$

wherein X and X' are as defined hereinbefore, and (C) Chlorine wherein the mole ratio of (A):(B) is such that there is at least about 1.3 moles cf (B) for each mole of (A) wherein the number of moles of (A) is the quotient of the total weight of (A) divided by the value of Mn and the amount of chlorine employed is such as to provide at least about 0.2 mole (preferably at least about 0.5 mole) of chlorine for each mole of (B) to be reacted with (A), said substituted acylating compositions being characterized by the presence within their structure of an average of at least 1.3 groups derived from (B) for each equivalent weight of the substituent groups derived from (A).

The terminology "substituted succinic acylating agent(s)" is used herein in describing the substituted succinic acylating agents regardless of the process by which they are produced. Obviously, as discussed in more detail hereinbefore, several processes are available for producing the substituted succinic acylating agents. On the other hand, the terminology "substituted acylating composition(s)", may be used to describe the reaction mixtures produced by the specific preferred processes described in detail herein. Thus, the identity of particular substituted acylating compositions is dependent upon a particular process of manufacture. This is particularly true because, while the products of this invention are clearly substituted succinic acylating agents as defined and discussed above, their structure cannot be represented by a single specific chemical formula. In fact, mixtures of products are inherently present. For purposes of brevity, the terminology "acylating reagent(s)" is often used hereinafter to refer, collectively, to both the substituted succinic acylating agents and to the substituted acylating compositions.

The acylating reagents described above are intermediates in processes for preparing the carboxylic derivative compositions (B) comprising reacting one or more acylating reagents (B-1) with at least one amino compound (B-2) characterized by the presence within its structure of at least one HN< group.

The amino compound (B-2) characterized by the presence within its structure of at least one HN< group can be a monoamine or polyamine compound. Mixtures of two or more amino compounds can be used in the reaction with one or more acylating reagents of this invention. Preferably, the amino compound contains at least one primary amino group (i.e., $—NH_2$) and more preferably the amine is a polyamine, especially a polyamine containing at least two —NH— groups, either or both of which are primary or secondary amines. The amines may be aliphatic, cycloaliphatic, aromatic or heterocyclic amines. The polyamines not only result in carboxylic acid derivative compositions which are usually more effective as dispersant/detergent additives, relative to derivative compositions derived from monoamines, but these preferred polyamines result in carboxylic derivative compositions which exhibit more pronounced V.I. improving properties.

The monoamines and polyamines must be characterized by the presence within their structure of at least one HN< group. Therefore, they have at least one primary (i.e., $H_2N—$) or secondary amino (i.e., HN=) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2$— $CH_2$—X—$CH_2CH_2$— where X is —O— or —S—).

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines and phenyl-substituted cyclopentylamines.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(-paramethylphenyl) amine, naphthylamine, N-(n-butyl-)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Polyamines are aliphatic, cycloaliphatic and aromatic polyamines analogous to the monoamines described above except for the presence within their structure of additional amino nitrogens. The additional amino nitrogens can be primary, secondary or tertiary amino nitrogens. Examples of such polyamines include N-aminopropyl-cyclohexylamines, N,N'-di-n-butyl-paraphenylene diamine, bis-(para-aminophenyl)methane, 1,4-diaminocyclohexane, and the like.

Heterocycic mono- and polyamines can also be used in making the carboxylic derivative compositions (B). As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The five- and six-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Hydroxy-substituted mono- and polyamines, analogous to the mono- and polyamines described above are also useful in preparing the carboxylic derivative (B) provided they contain at least one primary or secondary amino group. Hydroxy-substituted amines having only tertiary amino nitrogen such as in tri-hydroxyethyl amine, are thus excluded as amine reactants (B-2) but can be used as alcohols (D-2) in preparing component (D) as disclosed hereinafter. The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutylamine, diethanolamine, di-(2-hydroxypropyl)-amine, N-(hydroxypropyl)-propylamine, N-(2-hydroxyethyl)-cyclohexylamine, 3-hydroxycyclopentylamine, para-hydroxyaniline, N-hydroxyethyl piperazine, and the like.

Hydrazine and substituted hydrazine can also be used. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethyl-hydrazine, N,N'-dimethylhydrazine, phenylhydrazine, N-phenyl-N'-ethylhydrazine, N-(para-tolyl)-N'-(n-butyl)hydrazine, N-(para-nitrophenyl)-hydrazine, N-(para-nitrophenyl)-N-methyl-hydrazine, N,N'-di(-para-chlorophenol)hydrazine, N-phenyl-N'-cyclotexyl-hydrazine, and the like.

The high molecular weight hydrocarbyl amines, both mono-amines and polyamines, which can be used are generally prepared by reacting a chlorinated polyolefin having a molecular weight of at least about 400 with ammonia or amine. Such amines are known in the art and described, for example, in U.S. Pat. Nos. 3,275,554 and 3,438,757, both of which are expressly incorporated herein by reference for their disclosure in regard to how to prepare these amines. All that is required for use of these amines is that they possess at least one primary or secondary amino group.

Suitable amines also include polyoxyalkylene polyamines, e.g., polyoxyalkylene diamines and polyoxyalkylene triamines, having average molecular weights ranging from about 200 to 4000 and preferably from about 400 to 2000. Illustrative examples of these polyoxyalkylene polyamines may be characterized by the formulae $$NH_2\text{-Alkylene-}(\text{O—Alkylene})_m NH_2 \quad \text{(VI)}$$

wherein m has a value of about 3 to 70 and preferably about 10 to 35.

$$R\text{—Alkylene—O-}(\text{Alkylene})_n NH_2)_{3-6} \quad \text{(VII)}$$

wherein n is such that the total value is from about 1 to 40 with the proviso that the sum of all of the n's is from about 3 to about 70 and generally from about 6 to about 35 and R is a polyvalent saturated hydrocarbon radical of up to 10 carbon atoms having a valence of 3 to 6. The alkylene groups may be straight or branched chains and contain from 1 to 7 carbon atoms and usually from 1 to 4 carbon atoms. The various alkylene groups present within Formulae (VI) and (VII) may be the same or different.

The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403, etc.".

U.S. Pat. Nos. 3,804,763 and 3,948,800 are expressly incorporated herein by reference for their disclosure of such polyoxyalkylene polyamines and process for acylating them with carboxylic acid acylating agents which processes can be applied to their reaction with the acylating reagents used in this invention.

The most preferred amines are the alkylene polyamines, including the polyalkylene polyamines. The alkylene polyamines include those conforming to the formula $$R^3\text{—}\underset{\underset{R^3}{|}}{N}\text{—}(U\text{—}\underset{\underset{R^3}{|}}{N})_n\text{—}R^3 \quad \text{(VIII)}$$

wherein n is from 1 to about 10; each $R^3$ is independently a hydrogen atom, a hydrocarbyl group or a hydroxy-substituted or an amine-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms. Preferably U is ethylene or propylene. Especially preferred are the alkylene polyamines where each $R^3$ is independently hydrogen or an amino-substituted hydrocarbyl group with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the carboxylic derivative compositions (B) include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing the carboxylic derivatives (B) useful in this invention. On the other hand, quite satisfactory products can also be obtained by the use of pure alkylene polyamines.

Other useful types of polyamine mixtures are those resulting from stripping of the polyamine mixtures described above. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Texas designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Other polyamines (B-2) which can be reacted with the acylating agents (B-1) in accordance with this invention are described in, for example, U.S. Pat. Nos. 3,219,666 and 4,234,435, and these patents are hereby incorporated by reference for their disclosures of amines which can be reacted with the acylating agents described above to form the carboxylic derivatives (B) used in this invention.

Hydroxylalkyl alkylene polyamines having one or more hydroxyalkyl substituents on the nitrogen atoms, are also useful in preparing derivatives of the aforedescribed olefinic carboxylic acids. Preferred hydroxylalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl)ethylene diamine,N,N-bis(2-hydroxyethyl) ethylene diamine, 1-(2-hydroxyethyl) piperazine, mono-hydroxypropyl-substituted diethylene triamine, dihydroxypropyl-substituted tetraethylene pentamine, N-(2-hydroxybutyl)tetramethylene diamine, etc. Higher homologs as are obtained by condensation of the above-illustrated hydroxy alkylene polyamines through amino radicals or through hydroxy radicals are likewise useful as (a). Condensation through amino radicals results in a higher amine accompanied by removal cf ammonia and condensation through the hydroxy radicals results in products containing ether linkages accompanied by removal of water.

The carboxylic derivative compositions (B) produced from the acylating reagents (B-1) and the amino compounds (B-2) described hereinbefore comprise acylated amines which include amine salts, amides, imides and imidazolines as well as mixtures thereof. To prepare carboxylic acid derivatives from the acylating reagents and the amino compounds, one or more acylating reagents and one or more amino compounds are heated at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from about one-half equivalent up to less than one equivalent of amino compound per equivalent of acylating reagent.

Because the acylating reagents (B-1) can be reacted with the amine compounds (B-2) in the same manner as the high molecular weight acylating agents of the prior art are reacted with amines, U.S. Pat. Nos. 3,172,892; 3,219,666; 3,272,746; and 4,234,435 are expressly incorporated herein by reference for their disclosures with respect to the procedures applicable to reacting the acylating reagents with the amino compounds as described above. In applying the disclosures of these patents to the acylating reagents, the subsequent succinic acylating agents (B-1) of the present invention can be substituted for the high molecular weight carboxylic acid acylating agents disclosed in these patents on an equivalent basis. That is, where one equivalent of the high molecular weight carboxylic acylating agent disclosed in these incorporated patents is utilized, one equivalent of the acylating reagent of this invention can be used.

In order to produce carboxylic derivative compositions exhibiting viscosity index improving capabilities, it has been found generally necessary to react the acylating reagents with polyfunctional reactants. For example, polyamines having two or more primary and/or secondary amino groups are preferred. Obviously, however, it is not necessary that all of the amino compound reacted with the acylating reagents be polyfunctional. Thus, combinations of mono- and polyfunctional amino compounds can be used.

The relative amounts of the acylating agent (B-1) and amino compound (B-2) used to form the carboxylic derivative compositions B) used in the lubricating oil compositions of the present invention is a critical feature of the carboxylic derivative compositions (B). It is essential that the acylating agent (B-1) be reacted with less than one equivalent of the amino compound (B-2) per equivalent of acylating agent. It has been discovered that the incorporation of carboxylic derivatives prepared from such ratios in the lubricating oil compositions of the present invention results in improved viscosity index characteristics when compared to lubricating oil compositions containing carboxylic derivatives obtained by reacting the same acylating agents with one or more equivalents of amino compounds, per equivalent of acylating agent. In this regard refer to FIG. I which is a graph showing the relationship of polymer viscosity level versus two dispersant products of different acylating agent to nitrogen ratios in an SAE 5W-30 formulation. The viscosity of the blend is 10.2 cSt at 100° C. for all levels of dispersant, and the viscosity at −25° C. is 3300 cP at 4% dispersant. The solid line indicates the relative level of viscosity improver required at different concentrations of a prior art dispersant. The dashed line indicates the relative level of viscosity improver required at different concentrations of the dispersant of this invention (component (B) on a chemical basis). The prior art dispersant is obtained by reacting one equivalent of a polyamine with one equivalent of a succinic acylating agent having the characteristics of the acylating agents used to prepare component (B) of this invention. The dispersant of the invention is prepared by reacting 0.833 equivalent of the same polyamine with one equivalent of the same acylating agent.

As can be seen from the graph, oils containing the dispersant used in the present invention require less polymeric viscosity improver to maintain a given viscosity than the dispersant of the prior art, and the improvement is greater at the higher dispersant levels, e.g., at greater than 2% dispersant concentration.

In one embodiment, the acylating agent is reacted with from about 0.70 equivalent to about 0.95 equivalent of amino compound, per equivalent of acylating agent. In other embodiments, the lower limit on the equivalents of amino compound may be 0.75 or even 0.80 up to about 0.90 or 0.95 equivalent, per equivalent of acylating agent. Thus narrower ranges of equivalents of acylating agents (B-1) to amino compounds (B-2) may be from about 0.70 to about 0.90 or about 0.75 to about 0.90 or about 0.75 to about 0.85. It appears, at least in some situations, that when the equivalent of amino compound is about 0.75 or less, per equivalent of acylating agent, the effectiveness of the carboxylic derivatives as dispersants is reduced. In one embodiment, the relative amounts of acylating agent and amine are such that the carboxylic derivative preferably contains no free carboxyl groups.

The amount of amine compound (B-2) within these ranges that is reacted with the acylating agent (B-1) may also depend in part on the number and type of nitrogen atoms present. For example, a smaller amount of a polyamine containing one or more —$NH_2$groups is required to react with a given acylating agent than a polyamine having the same number of nitrogen atoms and fewer or no —$NH_2$groups. One —$NH_2$group can react with two —COOH groups to form an imide. If only secondary nitrogens are present in the amine compound, each NH group can react with only one —COOH group. Accordingly, the amount of polyamine within the above ranges to be reacted with the acylating agent to form the carboxylic derivatives of the invention can be readily determined from a consideration of the number and types of nitrogen atoms in the polyamine (i.e.., —$NH_2$, >NH, and >N—).

In addition to the relative amounts of acylating agent and amino compound used to form the carboxylic derivative composition (B), other critical features of the carboxylic derivative compositions (B) are the $\overline{M}n$ and the $\overline{M}w/\overline{M}n$ values of the polyalkene as well as the presence within the acylating agents of an average of at least 1.3 succinic groups for each equivalent weight of substituent groups. When all of these features are present in the carboxylic derivative compositions (B), the lubricating oil compositions of the present invention exhibit novel and improved properties, and the lubricating oil compositions are characterized by improved performance in combustion engines.

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\text{Mn})(\text{Sap No., corrected})}{112{,}200 - 98(\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

The preparation of the acylating agents and the carboxylic acid derivative compositions (B) is illustrated by the following examples. These examples illustrate presently preferred embodiments for obtaining the desired acylating agents and carboxylic acid derivative compositions sometimes referred to in the examples as "residue" or "filtrate" without specific determination or mention of other materials present or the amounts thereof. In the following examples, and elsewhere in the specification and claims, all percentages and parts are by weight unless otherwise clearly indicated.

ACYLATING AGENTS

Example 1

A mixture of 510 parts (0.28 mole) of polyisobutene ($\overline{M}n$=1845; $\overline{M}w$=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

Example 2

A mixture of 1000 parts (0.495 mole) of polyisobutene ($\overline{M}n$=2020; $\overline{M}w$=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C. an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

Example 3

A mixture of 3251 parts of polyisobutene chloride, prepared by the addition of 251 parts of gaseous chlorine to 3000 parts of polyisobutene ($\overline{M}n$=1696; $\overline{M}w$=6594) at 80° C. in 4.66 hours, and 345 parts of maleic anhydride is heated to 200° C. in 0.5 hour. The reaction mixture is held at 200°-224° C. for 6.33 hours, stripped at 210° C. under vacuum and filtered. The filtrate is the desired polyisobutene-substituted succinic acylating agent having a saponification equivalent number of 94 as determined by ASTM procedure D-94.

Example 4

A mixture of 3000 parts (1.63 moles) of polyisobutene ($\overline{M}n$=1845; $\overline{M}w$=5325) and 344 parts (3.51 moles) of maleic anhydride is heated to 140° C. This mixture is heated to 201° C. in 5.5 hours during which 312 parts (4.39 moles) of gaseous chlorine is added beneath the surface. The reaction mixture is heated at 201°-236° C. with nitrogen blowing for 2 hours and stripped under vacuum at 203° C. The reaction mixture is filtered to yield the filtrate as the desired polyisobutene-substituted succinic acylating agent having a saponification equivalent number of 92 as determined by ASTM procedure D-94.

Example 5

A mixture of 3000 parts (1.49 moles) of polyisobutene ($\overline{M}n=2020$; $\overline{M}w=6049$) and 364 parts (3.71 moles) of maleic anhydride is heated at 220° C. for 8 hours. The reaction mixture is cooled to 170° C. At 170°-190° C., 105 parts (1.48 moles) of gaseous chlorine is added beneath the surface in 8 hours. The reaction mixture is heated at 190° C. with nitrogen blowing for 2 hours and then stripped under vacuum at 190° C. The reaction mixture is filtered to yield the filtrate as the desired polyisobutene-substituted succinic acylating agent.

Example 6

A mixture of 800 parts of a polyisobutene falling within the scope of the claims of the present invention and having an $\overline{M}n$ of about 2000, 646 parts of mineral oil and 87 parts of maleic anhydride is heated to 179° C. in 2.3 hours. At 176°-180° C., 100 parts of gaseous chlorine is added beneath the surface over a 19-hour period. The reaction mixture is stripped by blowing with nitrogen for 0.5 hour at 180° C. The residue is an oil-containing solution of the desired polyisobutene-substituted succinic acylating agent.

Example 7

The procedure for Example 1 is repeated except the polyisobutene ($\overline{M}n=1845$; $\overline{M}w=5325$) is replaced on an equimolar basis by polyisobutene ($\overline{M}n=1457$ $\overline{M}w=5808$).

Example 8

The procedure for Example 1 is repeated except the polyisobutene ($\overline{M}n=1845$; $\overline{M}w=5325$) is replaced on an equimolar basis by polyisobutene ($\overline{M}n=2510$; $\overline{M}w=5793$).

Example 9

The procedure for Example 1 is repeated except the polyisobutene ($\overline{M}n=1845$; $\overline{M}w=5325$) is replaced on an equimolar basis by polyisobutene ($\overline{M}n=3220$; $\overline{M}w=5660$).

CARBOXYLIC DERIVATIVE COMPOSITIONS (B)

Example B-1

A mixture is prepared by the addition of 8.16 parts (0.20 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example 1 at 138° C. The reaction mixture is heated to 150° C. in 2 hours and stripped by blowing with nitrogen. The reaction mixture is filtered to yield the filtrate as an oil solution of the desired product.

Example B-2

A mixture is prepared by the addition of 45.6 parts (1.10 equivalents) of a commercial mixture of ethylene polyamines having from about 3 to 10 nitrogen atoms per molecule to 1067 parts of mineral oil and 893 parts (1.38 equivalents) of the substituted succinic acylating agent prepared in Example 2 at 140°-145° C. The reaction mixture is heated to 155° C. in 3 hours and stripped by blowing with nitrogen. The reaction mixture is filtered to yield the filtrate as an oil solution of the desired product.

Example B-3

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example 2 at 140° C. The reaction mixture is heated to 150° C. in 1.8 hours and stripped by blowing with nitrogen. The reaction mixture is filtered to yield the filtrate as an oil solution (55% oil) of the desired product.

Examples B-4 through B-17 are prepared by following the general procedure set forth in Example B-1.

| Example Number | Amine Reactant(s) | Equivalent Ratio of Acylating Agent To Reactants | Percent Dilutent |
|---|---|---|---|
| B-4 | Pentaethlene hexamine[a] | 4:3 | 40% |
| B-5 | Tris(2-aminoethyl) amine | 5:4 | 50% |
| B-6 | Imino-bis-propyl-amine | 8:7 | 40% |
| B-7 | Hexamethylene diamine | 4:3 | 40% |
| B-8 | 1-(2-Aminoethyl)-2-methyl-2-imidazoline | 5:4 | 40% |
| B-9 | N-aminopropyl-pyrrolidone | 8:7 | 40% |
| B-10 | N,N-dimethyl-1,3-Propane diamine | 5:4 | 40% |
| B-11 | Ethylene diamine | 4:3 | 40% |
| B-12 | 1,3-Propane diamine | 4:3 | 40% |
| B-13 | 2-Pyrrolidinone | 5:4 | 20% |
| B-14 | Urea | 5:4 | 50% |
| B-15 | Diethylenetri-amine[b] | 5:4 | 50% |
| B-16 | Triethylene-amine[c] | 4:3 | 50% |
| B-17 | Ethanolamine | 4:3 | 45% |

[a]A commercial mixture of ethylene polyamines corresponding in empirical formula to pentaethylene hexamine.
[b]A commercial mixture of ethylene polyamines corresponding in empirical formula to diethylene triamine.
[c]A commercial mixture of ethylene polyamines corresponding in empirical formula to triethylene tetramine.

Example B-18

An appropriate size flask fitted with a stirrer, nitrogen inlet tube, addition funnel and Dean-Stark trap/condenser is charged with a mixture of 2483 parts acylating agent (4.2 equivalents) as described in Example 3, and 1104 parts oil. This mixture is heated to 210° C. while nitrogen was slowly bubbled through the mixture. Ethylene polyamine bottoms (134 parts, 3.14 equivalents) are slowly added over about one hour at this temperature. The temperature is maintained at about 210° C. for 3 hours and then 3688 parts oil is added to decrease the temperature to 125° C. After storage at 138° C. for 17.5 hours, the mixture is filtered through diatomaceous earth to provide a 65% oil solution of the desired acylated amine bottoms.

Example B-19

A mixture of 3660 parts (6 equivalents) of a substituted succinic acylating agent prepared as in Example 1 in 4664 parts of diluent oil is prepared and heated at about 110° C. whereupon nitrogen is blown through the mixture. To this mixture there are then added 210 parts (5.25 equivalents) of a commercial mixture of ethylene polyamines containing from about 3 to about 10 nitrogen atoms per molecule over a period of one hour and the mixture is maintained at 110° C. for an additional 0.5 hour. After heating for 6 hours at 155° C. while removing water, a filtrate is added and the reaction mixture is filtered at about 150° C. The filtrate is the oil solution of the desired product.

Example B-20

The general procedure of Example B-19 is repeated with the exception that 0.8 equivalent of a substituted succinic acylating agent as prepared in Example 1 is reacted with 0.67 equivalent of the commercial mixture of ethylene polyamines. The product obtained in this manner is an oil solution of the product containing 55% diluent oil.

Example B-21

The general procedure of Example B-19 is repeated except that the polyamine used in this example is an equivalent amount of an alkylene polyamine mixture comprising 80% of ethylene polyamine bottoms from Union Carbide and 20% of a commercial mixture of ethylene polyamines corresponding in empirical formula to diethylene triamine. This polyamine mixture is characterized as having an equivalent weight of about 43.3.

Example B-22

The general procedure of Example B-20 is repeated except that the polyamine utilized in this example comprises a mixture of 80 parts by weight of ethylene polyamine bottoms available from Dow and 20 parts by weight of diethylenetriamine. This mixture of amines has an equivalent weight of about 41.3.

Example B-23

A mixture of 444 parts (0.7 equivalent) of a substituted succinic acylating agent prepared as in Example 1 and 563 parts of mineral oil is prepared and heated to 140° C. whereupon 22.2 parts of an ethylene polyamine mixture corresponding in empirical formula to triethylene tetramine (0.58 equivalent) are added over a period of one hour as the temperature is maintained at 140° C. The mixture is blown with nitrogen as it is heated to 150° C and maintained at this temperature for 4 hours while removing water. The mixture then is filtered through a filter aid at about 135° C., and the filtrate is an oil solution of the desired product comprising about 55% of mineral oil.

Example B-24

A mixture of 422 parts (0.7 equivalent) of a substituted succinic acylating agent prepared as in Example 1 and 188 parts of mineral oil is prepared and heated to 210° C. whereupon 22.1 parts (0.53 equivalent) of a commercial mixture of ethylene polyamine bottoms from Dow are added over a period of one hour blowing with nitrogen. The temperature then is increased to about 210°-216° C. and maintained at this temperature for 3 hours. Mineral oil (625 parts) is added and the mixture is maintained at 135° C. for about 17 hours whereupon the mixture is filtered and the filtrate is an oil solution of the desired product (65% oil).

Example B-25

The general procedure of Example B-24 is repeated except that the polyamine used in this example is a commercial mixture of ethylene polyamines having from about 3 to 10 nitrogen atoms per molecule (equivalent weight of 42).

Example B-26

A mixture is prepared of 414 parts (0.71 equivalent) of a substituted succinic acylating agent prepared as in Example 1 and 183 parts of mineral oil. This mixture is heated to 210° C. whereupon 20.5 parts (0.49 equivalent) of a commercial mixture of ethylene polyamines having from about 3 to 10 nitrogen atoms per molecule are added over a period of about one hour as the temperature is increased to 210°-217° C. The reaction mixture is maintained at this temperature for 3 hours while blowing with nitrogen, and 612 parts of mineral oil are added. The mixture is maintained at 145°-135° C. for about one hour, and at 135° C. for 17 hours. The mixture is maintained at this temperature for 3 hours while tion of the desired product (65% oil).

Example B-27

A mixture of 414 parts (0.71 equivalent) of a substituted succinic acylating agent prepared as in Example 1 and 184 parts of mineral oil is prepared and heated to about 80° C. whereupon 22.4 parts (0.534 equivalent) of melamine are added. The mixture is heated to 160° C. over a period of about 2 hours and maintained at this temperature for 5 hours. After cooling overnight, the mixture is heated to 170° C. over 2.5 hours and to 215° C. over a period of 1.5 hours. The mixture is maintained at about 215° C. for about 4 hours and at about 220° C. for 6 hours. After cooling overnight, the reaction mixture is filtered at 150° C. through a filter aid. The filtrate is an oil solution of the desired product (30% mineral oil).

Example B-28

A mixture of 414 parts (0.71 equivalent) of a substituted acylating agent prepared as in Example 1 and 184 parts of mineral oil is heated to 210° C. whereupon 21 parts (0.53 equivalent) of a commercial mixture of ethylene polyamine corresponding in empirical formula to tetraethylene pentamine are added over a period of 0.5 hour as the temperature is maintained at about 210°-217° C. Upon completion of the addition of the polyamine, the mixture is maintained at 217° C. for 3 hours while blowing with nitrogen. Mineral oil is added (613 parts) and the mixture is maintained at about 135° C. for 17 hours and filtered. The filtrate is an oil solution of the desired product (65% mineral oil).

Example B-29

A mixture of 414 parts (0.71 equivalent) of a substituted acylating agent prepared as in Example 1 and 183 parts of mineral oil is prepared and heated to 210° C. whereupon 18.3 parts (0.44 equivalent) of ethylene amine bottoms (Dow) are added over a period of one hour while blowing with nitrogen. The mixture is heated to about 210°-217° C. in about 15 minutes and maintained at this temperature for 3 hours. An additional 608 parts of mineral oil are added and the mixture is maintained at about 135° C. for 17 hours. The mixture is filtered at 135° C. through a filter aid, and the filtrate is an oil solution of the desired product (65% oil).

Example B-30

The general procedure of Example B-29 is repeated except that the ethylene amine bottoms are replaced by an equivalent amount of a commercial mixture of ethylene polyamines having from about 3 to 10 nitrogen atoms per molecule.

Example B-31

A mixture of 422 parts (0.70 equivalent) of a substituted acylating agent prepared as in Example 1 and 190 parts of mineral oil is heated to 210° C. whereupon 26.75 parts (0.636 equivalent) of ethylene amine bottoms (Dow) are added over one hour while blowing with nitrogen. After all of the ethylene amine is added, the mixture is maintained at 210°-215° C. for about 4 hours, and 632 parts of mineral oil are added with stirring. This mixture is maintained for 17 hours at 135° C. and filtered through a filter aid. The filtrate is an oil solution of the desired product (65% oil).

Example B-32

A mixture of 468 parts (0.8 equivalent) of a substituted succinic acylating agent prepared as in Example 1 and 908.1 parts of mineral oil is heated to 142° C. whereupon 28.63 parts (0.7 equivalent) of ethylene amine bottoms (Dow) are added over a period of 1.5-2 hours. The mixture was stirred an additional 4 hours at about 142° C. and filtered. The filtrate is an oil solution of the desired product (65% oil).

Example B-33

A mixture of 2653 parts of a substituted acylating agent prepared as in Example 1 and 1186 parts of mineral oil is heated to 210° C. whereupon 154 parts of ethylene amine bottoms (Dow) are added over a period of 1.5 hours as the temperature is maintained between 210°-215° C. The mixture is maintained at 215°-220° C. for a period of about 6 hours. Mineral oil (3953 parts) is added at 210° C. and the mixture is stirred for 17 hours with nitrogen blowing at 135°-128° C. The mixture is filtered hot through a filter aid, and the filtrate is an oil solution of the desired product (65% oil).

(C) Metal Dihydrocarbyl Dithiophosphate

The oil compositions of the present invention also contain (C) at least one metal salt of a dihydrocarbyl dithiophosphoric acid wherein (C-1) the dithiophosphoric acid is prepared by reacting phosphorus pentasulfide with an alcohol mixture comprising at least 10 mole percent of isopropyl alcohol and at least one primary aliphatic alcohol containing from about 3 to about 13 carbon atoms, and (C-2) the metal is a Group II metal, aluminum, tin, iron, cobalt, lead, molybdenum, manganese, nickel or copper.

Generally, the oil compositions of the present invention will contain varying amounts of one or more of the above-identified metal dithiophosphates such as from about 0.01 to about 2% by weight, and more generally from about 0.01 to about 1% by weight based on the weight of the total oil composition. The metal dithiophosphates are added to the lubricating oil compositions of the invention to improve the anti-wear and antioxidant properties of the oil compositions. The use of the metal salts of phosphorodithioic acids in the oil compositions of this invention results in lubricating oil compositions exhibiting improved properties, particularly, in diesel engines, when compared to oil compositions not containing such metal salts or containing different metal salts of dithiophosphoric acids.

The phosphorodithioic acids from which the metal salts useful in this invention are prepared are obtained by the reaction of about 4 moles of an alcohol mixture per mole of phosphorus pentasulfide, and the reaction may be carried out within a temperature range of from about 50° to about 200° C. The reaction generally is completed in about 1 to 10 hours, and hydrogen sulfide is liberated during the reaction.

The alcohol mixture which is utilized in the preparation of the dithiophosphoric acids useful in this invention comprise a mixture of isopropyl alcohol and at least one primary aliphatic alcohol containing from about 3 to 13 carbon atoms. In particular, the alcohol mixture will contain at least 10 mole percent of isopropyl alcohol and will generally comprise from about 20 mole percent to about 90 mole percent of isopropyl alcohol. In one preferred embodiment, the alcohol mixture will comprise from about 40 to about 60 mole percent of isopropyl alcohol, the remainder being one or more primary aliphatic alcohols.

The primary alcohols which may be included in the alcohol mixture include n-butyl alcohol, isobutyl alcohol, n-amyl alcohol, isoamyl alcohol, n-hexyl alcohol, 2-ethyl-1-hexyl alcohol, isooctyl alcohol, nonyl alcohol, decyl alcohol, dodecyl alcohol, tridecyl alcohol, etc. The primary alcohols also may contain various substituent groups such as halogens. Particular examples of useful mixtures of alcohols include, for example, isopropyl/n-butyl; isopropyl/secondary butyl; isopropyl/2-ethyl-1-hexyl; isopropyl/isooctyl; isopropyl/decyl; isopropyl/dodecyl; and isopropyl/tridecyl.

The composition of the phosphorodithioic acid obtained by the reaction of a mixture of alcohols (e.g., iPrOH and $R^2OH$) with phosphorus pentasulfide is actually a statistical mixture of three or more phosphorodithioic acids as illustrated by the following formulae:

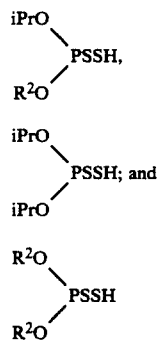

In the present invention it is preferred to select the amount of the two or more alcohols reacted with $P_2S_5$ to result in a mixture in which the predominating dithiophosphoric acid is the acid (or acids) containing one isopropyl group and one primary alkyl group. Relative amounts of the three phosphorodithioic acids in the statistical mixture is dependent, in part, on the relative amounts of the alcohols in the mixture, steric effects, etc.

The preparation of the metal salt of the dithiophosphoric acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water or diluent oil. Neutral salts are prepared by reacting one equivalent of metal oxide or hydroxide with one equivalent of the acid. Basic metal salts are prepared by adding an excess of (more than one equivalent) the metal oxide or hydroxide with one equivalent of phosphorodithioic acid.

The metal salts of dihydrocarbyl dithiophosphoric acids (C) which are useful in this invention include those salts containing Group II metals, aluminum, lead, tin, molybdenum, manganese, cobalt, and nickel. Zinc and copper are especially useful metals. Examples of metal compounds which may be reacted with the acid include silver oxide, silver carbonate, magnesium oxide, magnesium hydroxide, magnesium carbonate, magnesium ethylate, calcium oxide, calcium hydroxide, zinc oxide, zinc hydroxide, strontium oxide, strontium hydroxide, cadmium oxide, cadmium carbonate, barium oxide, barium hydrate, aluminum oxide, aluminum propylate, iron carbonate, copper hydroxide, lead oxide, tin butylate, cobalt oxide, nickel hydroxide, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

The following examples illustrate the preparation of the metal salts of dithiophosphoric acid prepared from mixtures of alcohols containing isopropyl alcohol and at least one primary alcohol.

Example C-1

A phosphorodithioic acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

Example C-2

(a) A phosphorodithioic acid is prepared by reacting a mixture of 1560 parts (12 moles) of isooctyl alcohol and 180 parts (3 moles) of isopropyl alcohol with 756 parts (3.4 moles) cf phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through a filter aid.

(b) Zinc oxide (282 parts, 6.87 moles) is charged to a reactor with 278 parts of mineral oil. The phosphorodithioic acid prepared in (a) (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm.Hg., the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

Example C-3

(a) Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

(b) A reactor is charged with 312 parts (7.7 equivalents) of zinc oxide and 580 parts of mineral oil. While stirring at room temperature, the phosphorodithioic acid prepared in (a) (2287 parts, 6.97 equivalents) is added over a period of about 1.26 hours with an exotherm to 54° C. The mixture is heated to 78° C. and maintained at 78°–85° C. for 3 hours. The reaction mixture is vacuum stripped to 100° C. at 19 mm.Hg. The residue is filtered through a filter aid, and the filtrate is an oil solution (19.2% oil) of the desired zinc salt containing 7.86% zinc, 7.76% phosphorus and 14.8% sulfur.

Example C-4

The general procedure of Example C-3 is repeated except that the mole ratio of isopropyl alcohol to isooctyl alcohol is 1:1. The product obtained in this manner is an oil solution 10% oil) of the zinc phosphorodithioate containing 8.96% zinc, 8.49% phosphorus and 18.05% sulfur.

Example C-5

A phosphorodithioic acid is prepared in accordance with the general procedure of Example C-3 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles) of zinc oxide with 950.8 parts (3.20 moles) of the above-prepared phosphorodithioic acid. The product prepared in this manner is an oil solution (10% mineral oil) of the desired zinc salt, and the oil solution contains 9.36% zinc, 8.81% phosphorus and 18.65% sulfur.

Example C-6

(a) A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while stirring. The reaction then is maintained at 60°–65° C. for about one hour and filtered. The filtrate is the desired phosphorodithioic acid.

(b) An oil slurry of 188.6 parts (4 moles) of zinc oxide and 144.2 parts of mineral oil is prepared, and 1145 parts of the phosphorodithioic acid prepared in (a) are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

Example C-7

A phosphorodithioic acid is prepared by the general procedure of Example C-3 utilizing 260 parts (2 moles) of isooctyl alcohol, 480 parts (8 moles) of isopropyl alcohol, and 504 parts (2.27 moles) of phosphorus pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 mm.Hg., the mixture is filtered twice through a filter aid, and the filtrate is an oil solution (10% mineral oil) of the zinc salt containing 10.06% zinc, 9.04% phosphorus, and 19.2% sulfur.

Example C-8

(a) A mixture of 259 parts (3.5 moles) of normal butyl alcohol and 90 parts (1.5 moles) of isopropyl alcohol is heated to 40° C. under a nitrogen atmosphere whereupon 244.2 parts (1.1 moles) of phosphorus pentasulfide are added in portions over a period of one hour while maintaining the temperature of the mixture of between about 55°-75° C. The mixture is maintained at this temperature for an additional 1.5 hours upon completion of the addition of the phosphorus pentasulfide and then cooled to room temperature. The reaction mixture is filtered through a filter aid, and the filtrate is the desired phosphorodithioic acid.

(b) Zinc oxide (67.7 parts, 1.65 equivalents) and 51 parts of mineral oil are charged to a 1-liter flask and 410.1 parts (1.5 equivalents) of the phosphorodithioic acid prepared in (a) are added over a period of one hour while raising the temperature gradually to about 67° C. Upon completion of the addition of the acid, the reaction mixture is heated to 74° C. and maintained at this temperature for about 2.75 hours. The mixture is cooled to 50° C., and a vacuum is applied while raising the temperature to about 82° C. The residue is filtered, and the filtrate is the desired product. The product is a clear, yellow liquid containing 21.0% sulfur (19.81 theory), 10.71% zinc (10.05 theory), and 0.17% phosphorus (9.59 theory).

Example C-9

(a) A mixture of 240 (4 moles) parts of isopropyl alcohol and 444 parts of n-butyl alcohol (6 moles) is prepared under a nitrogen atmosphere and heated to 50° C. whereupon 504 parts of phosphorus pentasulfide (2.27 moles) are added over a period of 1.5 hours. The reaction is exothermic to about 68° C., and the mixture is maintained at this temperature for an additional hour after all of the phosphorus pentasulfide is added. The mixture is filtered through a filter aid, and the filtrate is the desired phosphorodithioic acid.

(b) A mixture of 162 parts (4 equivalents) of zinc oxide and 113 parts of a mineral oil is prepared, and 917 parts (3.3 equivalents) of the phosphorodithioic acid prepared in (a) are added over a period of 1.25 hours. The reaction is exothermic to 70° C. After completion of the addition of the acid, the mixture is heated for three hours at 80° C., and stripped to 100° C. at 35 mm.Hg. The mixture then is filtered twice through a filter aid, and the filtrate is the desired product. The product is a clear, yellow liquid containing 10.71% zinc (9.77 theory), 10.4% phosphorus and 21.35% sulfur.

Example C-10

(a) A mixture of 420 parts (7 moles) of isopropyl alcohol and 518 parts (7 moles) of n-butyl alcohol is prepared and heated to 60° C. under a nitrogen atmosphere. Phosphorus pentasulfide (647 parts, 2.91 moles) is added over a period of one hour while maintaining the temperature at 65°-77° C. The mixture is stirred an additional hour while cooling. The material is filtered through a filter aid, and the filtrate is the desired phosphorodithioic acid.

(b) A mixture of 113 parts (2.76 equivalents) of zinc oxide and 82 parts of mineral oil is prepared and 662 parts of the phosphorodithioic acid prepared in (a) are added over a period of 20 minutes. The reaction is exothermic and the temperature of the mixture reaches 70° C. The mixture then is heated to 90° C. and maintained at this temperature for 3 hours. The reaction mixture is stripped to 105° C. and 20 mm.Hg. The residue is filtered through a filter aid, and the filtrate is the desired product containing 10.17% phosphorus, 21.0% sulfur and 10.98% zinc.

Example C-11

A mixture of 69 parts (0.97 equivalent) of cuprous oxide and 38 parts of mineral oil is prepared and 239 parts (0.88 equivalent) of the phosphorodithioic acid prepared in Example C-10(a) are added over a period of about 2 hours. The reaction is slightly exothermic during the addition, the mixture is thereafter stirred for an additional 3 hours while maintaining the temperature at about 70° C. The mixture is stripped to 105° C./10 mm.Hg. and filtered. The filtrate is a dark-green liquid containing 17.3% copper.

Example C-12

A mixture of 29.3 parts (1.1 equivalents) of ferric oxide and 33 parts of mineral oil is prepared, and 273 parts (1.0 equivalent) of the phosphosodithioic acid prepared in Example C-10(a) are added over a period of 2 hours. The reaction is exothermic during the addition, and the mixture is thereafter stirred an additional 3.5 hours while maintaining the mixture at 70° C. The product is stripped to 105° C./10 mm.Hg. and filtered through a filter aid. The filtrate is a black-green liquid containing 4.9% iron and 10.0% phosphorus.

Example C-13

A mixture of 239 parts (0.41 mole) of the product of Example C-10(a), 11 parts (0.15 mole) of calcium hydroxide and 10 parts of water is heated to about 80° C. and maintained at this temperature for 6 hours. The product is stripped to 105° C./10 mm.Hg. and filtered through a filter aid. The filtrate is a molasses-colored liquid containing 2.19% calcium.

Example C-14

(a) A mixture of 296 parts (4 moles) of n-butyl alcohol, 240 parts (4 moles) of isopropyl alcohol and 92 parts (2 moles) of ethanol is warmed to 40° C. under a nitrogen atmosphere, and phosphorus pentasulfide (504 parts, 2.7 moles) is added slowly over a period of about 1.5 hours while maintaining the reaction temperature at about 65°-70° C. Following completion of the addition of the phosphorus pentasulfide, the reaction mixture is maintained at this temperature for an additional 1.5 hours. After cooling to 40° C., the mixture is filtered through a filter aid. The filtrate is the desired phosphorodithioic acid.

(b) A mixture of 112.7 parts (2.7 equivalents) of zinc oxide and 79.1 parts of mineral oil is prepared, and 632.3 parts (2.5 equivalents) of the phosphorodithioic acid prepared in (a) are added over a period of 2 hours while maintaining the reaction temperature at about 65° C. or less. The mixture then is heated to 75° C. and maintained at this temperature for 3 hours. The mixture then is stripped to 100° C./15 mm.Hg., and the residue is filtered through a filter aid. The filtrate is the desired product, and is a clear, yellow liquid containing 11.04% zinc.

Additional specific examples of metal phosphorodithioates useful as component (C) in the lubricating oils of the present invention are listed in the following table.

TABLE I

| Component C: Metal Phosphorodithioates | | |
|---|---|---|
| Example | Alcohol Mixture | Metal |
| C-15 | (isopropyl + dodecyl) (1:1)m | Zn |
| C-16 | (isopropyl + isooctyl) (1:1)m | Ba |
| C-17 | (isopropyl + isooctyl) (40:60)m | Cu |
| C-18 | (isopropyl + isoamyl) (65:35)m | Zn |

In addition to the metal salts of dithiophosphoric acids derived from mixtures of alcohols comprising isopropyl alcohol and one or more primary alcohols as described above, the lubricating oil compositions of the present invention also may contain metal salts of other dithiophosphoric acids. These additional phosphorodithioic acids are prepared from (a) a single alcohol which may be either a primary or secondary alcohol or (b) mixtures of primary alcohols or (c) mixtures of isopropyl alcohol and secondary alcohols or (d) mixtures of primary alcohols and secondary alcohols other than isopropyl alcohol, or (e) mixtures of secondary alcohols.

Additional metal phosphorodithioates which can be utilized in combination with component (C) in the lubricating oil compositions of the present invention generally may be represented by the formula

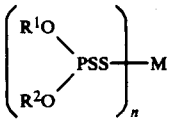

(IX)

wherein $R^1$ and $R^2$ are hydrocarbyl groups containing from 3 to about 10 carbon atoms, M is a Group I metal, a Group II metal, aluminum, tin, iron, cobalt, lead, molybdenum, manganese, nickel or copper, and n is an integer equal to the valence of M. The hydrocarbyl groups $R^1$ and $R^2$ in the dithiophosphate of Formula IX may be alkyl, cycloalkyl, arylalkyl or alkaryl groups, or a substantially hydrocarbon group of similar structure. By "substantially hydrocarbon" is meant hydrocarbons which contain substituent groups such as ether, ester, nitro or halogen which do not materially affect the hydrocarbon character of the group.

In one embodiment, one of the hydrocarbyl groups ($R^1$ or $R^2$) is attached to the oxygen through a secondary carbon atom, and in another embodiment, both hydrocarbyl groups ($R^1$ and $R^2$) are attached to the oxygen atom through secondary carbon atoms.

Illustrative alkyl groups include isopropyl, isobutyl, n-butyl, sec-butyl, the various amyl groups, n-hexyl, methyl isobutyl, heptyl, 2-ethyl hexyl, diisobutyl, isooctyl, nonyl, behenyl, decyl, dodecyl, tridecyl, etc. Illustrative lower alkyl phenyl groups include butyl phenyl, amyl phenyl, heptyl phenyl, etc. Cycloalkyl groups likewise are useful, and these include chiefly cyclohexyl, and the lower alkyl-substituted cyclohexyl groups.

The metal M of the metal dithiophosphate of Formula IX includes Group I metals, Group II metals, aluminum, lead, tin, molybdenum, manganese, cobalt and nickel. In some embodiments, zinc and copper are especially useful metals.

The metal salts represented by Formula IX can be prepared by the same methods as described above with respect to the preparation of the metal salts of component (C). Of course, as mentioned above, when mixtures of alcohols are utilized, the acids obtained are actually statistical mixtures of alcohols.

The following examples illustrate the preparation of metal salts as represented by Formula IX which are different from the salts included in component (C).

Example P-1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times the theoretical amount required to completely neutralize the phosphorodithioic acid. The oil solution of the zinc phosphorodithioate obtained in this manner (10% oil) contains 9.5% phosphorus, 20.0% sulfur and 10.5% zinc.

Example P-2

(a) A mixture of 185 parts (2.5 moles) of n-butyl alcohol, 74 parts (1.0 mole) of isobutyl alcohol and 90 parts (1.5 moles) of isopropyl alcohol is prepared with stirring under a nitrogen atmosphere. The mixture is heated to 60° C., and 231 parts (1.04 moles) of phosphorus pentasulfide are added over a periof of about one hour while maintaining the temperature at about 58°-65° C. The mixture is stirred an additional 1.75 hours allowing the temperature to fall to room temperature. After standing overnight, the reaction mixture is filtered through paper, and the filtrate is the desired phosphorodithioic acid.

(b) A mixture of 64 parts of mineral oil and 84 parts (2.05 equivalents) of zinc oxide is prepared with stirring, and 525 parts (1.85 equivalents) of the phosphorodithioic acid prepared in (a) are added over a period of 0.5 hour with a exotherm to 65° C. The mixture is heated to 80° C. and maintained at that temperature for 3 hours. The mixture is stripped to 106° C./8 mm.Hg. The residue is filtered through a filter aid, and the filtrate is the desired product, a clear amber liquid.

Example P-3

(a) The mixture of 111 parts (1.5 moles) of n-butyl alcohol, 148 parts (2.0 moles) of secondary butyl alcohol and 90 parts (1.5 moles) of isopropyl alcohol is prepared in a nitrogen atmosphere and heated to about 63° C. Phosphorus pentasulfide (231 parts, 1.04 moles) is added in about 1.3 hours with an exotherm to about 55°-65° C. The mixture is stirred an additional 1.75 hours allowing the temperature to fall to room temperature. After allowing the mixture to stand overnight, the mixture is filtered through paper, and the filtrate is the desired phosphorodithioic acid, a clear, green-gray liquid.

(b) A mixture of 80 parts (1.95 equivalents) of zinc oxide and 62 parts (1.77 equivalents) of mineral oil is prepared and 520 parts of the phosphorodithioic acid prepared in (a) are added over a period of 25 minutes with an exotherm to 66° C. The mixture is heated to a temperature of 80° C. and maintained between 80°-88° C. for 5 hours. The mixture then is stripped to 105° C./9 mm.Hg. The residue is filtered through a filter aid, and the filtrate is the desired product, a clear, greenish-gold liquid.

Additional examples of metal phosphorodithioates represented by Formula IX are found in the following Table II.

TABLE II

Metal Phosphorodithioates

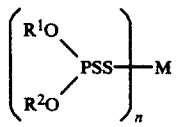

| Example | $R^1$ | $R^2$ | M | n |
|---|---|---|---|---|
| P-4 | n-nonyl | n-nonyl | Ba | 2 |
| P-5 | cyclohexyl | cyclohexyl | Zn | 2 |
| P-6 | isobutyl | isobutyl | Zn | 2 |
| P-7 | hexyl | hexyl | Ca | 2 |
| P-8 | n-decyl | n-decyl | Zn | 2 |
| P-9 | 4-methyl-2-pentyl | 4-methyl-2-pentyl | Cu | 2 |
| P-10 | (n-butyl + dodecyl) (1:1)m | | Zn | 2 |
| P-11 | (4-methyl-2-pentyl + sec butyl) (1:1)m | | Zn | 2 |
| P-12 | isobutyl + isoamyl (65:35)m | | Zn | 2 |

Another class of the phosphorodithioate additives contemplated for use in the lubricating composition of this invention comprises the adducts of the metal phosphorodithioates of component (C) and those of Formula IX described above with an epoxide. The metal phosphorodithioates useful in preparing such adducts are for the most part the zinc phosphorodithioates. The epoxides may be alkylene oxides or arylalkylene oxides. The arylalkylene oxides are exemplified by styrene oxide, p-ethylstyrene oxide, alpha-methylstyrene oxide, 3-beta-naphthyl-1,1,3-butylene oxide, m-dodecylstyrene oxide, and p-chlorostyrene oxide. The alkylene oxides include principally the lower alkyene oxides in which the alkylene radical contains 8 or less carbon atoms. Examples of such lower alkylene oxides are ethylene oxide, propylene oxide, 1,2-butene oxide, trimethylene oxide, tetramethylene oxide, butadiene monoepoxide, 1,2-hexene oxide, and epichlorohydrin. Other epoxides useful herein include, for example, butyl 9,10-epoxystearate, epoxidized soya bean oil, epoxidized tung oil, and epoxidized copolymer of styrene with butadiene. Procedures for preparing epoxide adduccts are known in the art such as in U.S. Pat. No. 3,390,082, and the disclosure of this patent is hereby incorporated by reference for its disclosure of the general procedures of preparing epoxide adducts of metal salt of phosphorodithioic acids.

The adduct may be obtained by simply mixing the metal phosphorodithioate and the epoxide. The reaction is usually exothermic and may be carried out within wide temperature limits from about 0° C. to about 300° C. Because the reaction is exothemic, it is best carried out by adding one reactant, usually the epoxide, in small increments to the other reactant in order to obtain convenient control of the temperature of the reaction. The reaction may be carried out in a solvent such as benzene, mineral oil, naphtha, or n-hexene.

The chemical structure of the adduct is not known. For the purpose of this invention adducts obtained by the reaction of one mole of the phosphorodithioate with from about 0.25 mole to 5 moles, usually up to about 0.75 mole or about 0.5 mole of a lower alkylene oxide, particularly ethylene oxide and propylene oxide, have been found to be especially useful and therefore are preferred.

The preparation of such adducts is more specifically illustrated by the following examples.

Example C-19

A reactor is charged with 2365 parts (3.33 moles) of the zinc phosphorodithioate prepared in Example C-2, and while stirring at room temperature, 38.6 parts (0.67 mole) of propylene oxide are added with an exotherm of from 24°-31° C. The mixture is maintained at 80°-90° C. for 3 hours and then vacuum stripped to 101° C. at 7 mm. Hg. The residue is filtered using a filter aid, and the filtrate is an oil solution (11.8% oil) of the desired salt containing 17.1% sulfur, 8.17% zinc and 7.44% phosphorus.

Example P-13

To 394 parts (by weight) of zinc dioctylphosphorodithioate having a phosphorus content of 7% there is added at 75°-85° C., 13 parts of propylene oxide (0.5 mole per mole of the zinc phosphorodithioate) throughout a period of 20 minutes. The mixture is heated at 82°-85° C. for one hour and filtered. The filtrate (399 parts) is found to contain 6.7% of phosphorus, 7.4% of zinc, and 4.1% of sulfur.

Another class of the phosphorodithioate additives (C) contemplated as useful in the lubricating compositions of the invention comprises mixed metal salts of (a) at least one phosphorodithioic acid of Formula IX as defined and exemplified above, and (b) at least one aliphatic or alicyclic carboxylic acid. The carboxylic acid may be a monocarboxylic or polycarboxylic acid, usually containing from 1 to about 3 carboxy groups and preferably only 1. It may contain from about 2 to about 40, preferably from about 2 to about 20 carbon atoms, and advantageously about 5 to about 20 carbon atoms. The preferred carboxylic acids are those having the formula $R^3COOH$, wherein $R^3$ is an aliphatic or alicyclic hydrocarbon-based radical preferably free from acetylenic unsaturation. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. For the most part, $R^3$ is a saturated aliphatic group and especially a branched alkyl group such as the isopropyl or 3-heptyl group. Illustrative polycarboxylic acids are succinic, alkyl- and alkenylsuccinic, adipic, sebacic and citric acids.

The mixed metal salts may be prepared by merely blending a metal salt of a phosphorodithioic acid with a metal salt of a carboxylic acid in the desired ratio. The ratio of equivalents of phosphorodithioic to carboxylic acid salts is between about 0.5:1 to about 400:1. Preferably, the ratio is between about 0.5:1 and about 200:1. Advantageously, the ratio can be from about 0.5:1 to about 100:1, preferably from about 0.5:1 to about 50:1, and more preferably from about 0.5:1 to about 20:1. Further, the ratio can be from about 0.5:1 to about 4.5:1, preferably about 2.5:1 to about 4.25:1. For this purpose, the equivalent weight of a phosphorodithioic acid is its molecular weight divided by the number of —PSSH groups therein, and that of a carboxylic acid is its molecular weight divided by the number of carboxy groups therein.

A second and preferred method for preparing the mixed metal salts useful in this invention is to prepare a mixture of the acids in the desired ratio and to react the acid mixture with a suitable metal base. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts useful in this invention. For example, a metal salt of either acid may be blended with an acid of the other, and the resulting blend reacted with additional metal base.

Suitable metal bases for the preparation of the mixed metal salts include the free metals previously enumerated and their oxides, hydroxides, alkoxides and basic salts. Examples are sodium hydroxide, potassium hydroxide, magnesium oxide, calcium hydroxide, zinc oxide, lead oxide, nickel oxide and the like.

The temperature at which the mixed metal salts are prepared is generally between about 30° C. and about 150° C., preferably up to about 125° C. If the mixed salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,970 describe procedures for preparing these mixed metal salts and disclose a number of examples of such mixed salts. Such disclosures of these patents are hereby incorporated by reference.

The preparation of the mixed salts is illustrated by the following examples. All parts and percentages are by weight.

Example P-14

A mixture of 67 parts (1.63 equivalents) of zinc oxide and 48 parts of mineral oil is stirred at room temperature and a mixture of 401 parts (1 equivalent) of di-(2-ethylhexyl) phosphorodithioic acid and 36 parts (0.25 equivalent) of 2-ethylhexanoic acid is added over 10 minutes. The temperature increases to 40° C. during the addition. When addition is complete, the temperature is increased to 80° C. for 3 hours. The mixture is then vacuum stripped at 100° C. to yield the desired mixed metal salt as a 91% solution in mineral oil.

Example P-15

Following the procedure of Example P-14, a product is prepared from 383 parts (1.2 equivalents) of a dialkyl phosphorodithioic acid containing 65% isobutyl and 35% amyl groups, 43 parts (0.3 equivalent) of 2-ethylhexanoic acid, 71 parts (1.73 equivalents) of zinc oide and 47 parts of mineral oil. The resulting mixed metal salt, obtained as a 90% solution in mineral oil, contains 11.07% zinc.

(D) Carboxylic Ester Derivative Compositions

The lubricating oil compositions of the present invention also may contain (D) at least one carboxylic ester derivative composition produced by reacting (D-1) at least one substituted succinic acylating agent with (D-2) at least one alcohol or phenol of the general formula $$R^3(OH)m \qquad (X)$$

wherein $R^3$ is a monovalent or polyvalent organic group joined to the —OH groups through a carbon bond, and m is an integer of from 1 to about 10. The carboxylic ester derivatives (D) are included in the oil compositions to provide additional dispersancy, and in some applications, the ratio of carboxyl derivative (B) to carboxylic ester (D) present in the oil can be varied to improve the properties of the oil composition such as the anti-wear properties.

In one embodiment the use of a carboxylic derivative (B) in combination with a smaller amount of the carboxylic esters (D) (e.g., a weight ratio of 2:1 to 4:1) in the presence of the specific metal dithiophosphate (C) of the invention results in oils having especially desirable properties (e.g., anti-wear and minimum varnish and sludge formation). Such oil compositions are particularly used in diesel engines.

The substituted succinic acylating agents (D-2) which are reacted with the alcohols or phenols to form the carboxylic ester derivatives (D) are identical to the acylating agents (B-1) used in the preparation of the carboxylic derivatives (B) described above with one exception. The polyalkene from which the substituent is derived is characterized as having a number average molecular weight of at least about 700.

Number average molecular weights of from about 700 to about 5000 are preferred. In one embodiment, the substituent groups of the acylating agent are derived from polyalkenes which are characterized by an Mn value of about 1300 to 5000 and an $\overline{Mw}/\overline{Mn}$ value of about 1.5 to about 4.5. The acylating agents of this embodiment are identical to the acylating agents described earlier with respect to the preparation of the carboxylic derivative compositions useful as component (B) described above. Thus, any of the acylating agents described in regard to the preparation of component (B)

above, can be utilized in the preparation of the carboxylic ester derivative compositions useful as component (D). When the acylating agents used to prepare the carboxylic ester (D) are the same as those acylating agents used for preparing component (B), the carboxylic ester component (D) will also be characterized as a dispersant having VI properties. Also combinations of component (B) and these preferred types of component (D) used in the oils of the invention provide superior anti-wear characteristics to the oils of the invention. However, other substituted succinic acylating agents also can be utilized in the preparation of the carboxylic ester derivative compositions which are useful as component (D) in the present invention. For example, substituted succinic acylating agents wherein the substituent is derived from a polyalkene having molecular weight ($\overline{M}n$) of 800–1200 are useful.

The carboxylic ester derivative compositions (D) are those of the above-described succinic acylating agents with hydroxy compounds which may be aliphatic compounds such as monohydric and polyhydric alcohols or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols (D-2) from which the esters may be derived preferably contain up to about 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, mono-oleate of ethylene glycol, monostearate of diethylene glycol, sec-pentyl alcohol, tert-butyl alcohol, 5-bromo-dodecanol, nitrooctadecanol and dioleate of glycerol. The polyhydric alcohols preferably contain from 2 to about 10 hydroxy groups. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene group contains from 2 to about 8 carbon atoms. Other useful polyhydric alcohols include glycerol, monooleate of glycerol, monostearate of glycerol, monomethyl ether of glycerol, pentaerythritol, 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylylene glycol.

An especially preferred class of polyhydric alcohols are those having at least three hydroxy groups, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters (D) may also be derived from unsaturated alcohols such as allyl alcohol, cinnamyl alcohol, propargyl alcohol, 1-cyclohexen-3-ol, and oleyl alcohol. Still other classes of the alcohols capable of yielding the esters of this invention comprises the ether-alcohols and amino-alcohols including, for example, the oxy-alkylene-, oxy-arylene-, amino-alkylene-, and amino-arylene-substituted alcohols having one or more oxy-alkylene, amino-alkylene or amino-arylene oxy-arylene groups. They are exemplified by Cellosolve, Carbitol, phenoxyethanol, mono(heptylphenyl-oxypropylene)-substituted glycerol, poly(styrene oxide), aminoethanol, 3-amino ethylpentanol, di(hydroxyethyl) amine, p-aminophenol, tri(hydroxypropyl)amine, N-hydroxyethyl ethylene diamine, N,N,N',N'-tetrahydroxytrimethylene diamine, and the like. For the most part, the ether-alcohols having up to about 150 oxy-alkylene groups in which the alkylene group contains from 1 to about 8 carbon atoms are preferred.

The esters may be diesters of succinic acids or acidic esters, i.e., partially esterified succinic acids; as well as partially esterified polyhydric alcohols or phenols, i.e., esters having free alcoholic or phenolic hydroxyl groups. Mixtures of the esters illustrated above likewise are contemplated within the scope of this invention.

A suitable class of esters for use in the lubricating compositions of this invention are those diesters of succinic acid and an alcohol having up to about 9 aliphatic carbon atoms and having at least one substituent selected from the class consisting of amino and carboxy groups wherein the hydrocarbon substituent of the succinic acid is a polymerized butene substituent having a number average molecular weight of from about 700 to about 5000.

The esters (D) may be prepared by one of several known methods. The method which is preferred because of convenience and the superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C. The water formed as a by product is removed by distillation as the esterification proceeds.

In most cases the carboxylic ester derivatives are a mixture of esters, the precise chemical composition and the relative proportions of which in the product are difficult to determine. Consequently, the product of such reaction is best described in terms of the process by which it is formed.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid groups is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl groups of the alcohol is esterified with one of the two acid groups of the succinic acid. Thus, the maximum proportion of the succinic acid to be used with a polyhydric alcohol is determined by the number of hydroxyl groups present in the molecule of the hydroxy reactant. In one embodiment, esters obtained by the reaction of equimolar amounts of the succinic acid reactant and hydroxy reactant are preferred.

In some instances it is advantageous to carry out the esterification in the presence of a catalyst such as sulfuric acid, pyridine hydrochloride, hydrochloric acid, benzene sulfonic acid, p-toluene sulfonic acid, phosphoric acid, or any other known esterification catalyst. The amount of the catalyst in the reaction may be as little as 0.01% (by weight of the reaction mixture), more often from about 0.1% to about 5%.

The esters (D) may be obtained by the reaction of a substituted succinic acid or anhydride with an epoxide or a mixture of an epoxide and water. Such reaction is similar to one involving the acid or anhydride with a glycol. For instance, the ester may be prepared by the reaction of a substituted succinic acid with one mole of ethylene oxide. Similarly, the ester may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soybean oil, methyl ester of 9,10-epoxy-stearic acid, and butadiene monoepoxide. For the most part, the epoxides are the alkylene oxides in which the alkylene group has from 2 to about 8 carbon atoms; or the epoxidized fatty acid esters in which the fatty acid group has up to about 30 carbon atoms and the ester group is derived from a lower alcohol having up to about 8 carbon atoms.

In lieu of the succinic acid or anhydride, a substituted succinic acid halide may be used in the processes illustrated above for preparing the esters. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorus tribromide, phosphorus pentachloride, or thionyl chloride. Methods of preparing the carboxylic esters (D) are well known in the art and need not be illustrated in further detail here. For example, see U.S. Pat. No. 3,522,179 which is hereby incorporated by reference for its disclosure of the preparation of carboxylic ester compositions useful as component (D). The preparation of carboxylic ester derivative compositions from acylating agents wherein the substituent groups are derived from polyalkenes characterized by an Mn of at least about 1300 up to about 5000 and an Mw/Mn ratio of from 1.5 to about 4 is described in U.S. Pat. No. 4,234,435 which is hereby incorporated by reference. The acylating agents described in the '435 patent are also characterized as having within their structure an average of at least 1.3 succinic groups for each equivalent weight of substituent groups.

The following examples illustrate the esters (D) and the processes for preparing such esters.

Example D-1

A substantially hydrocarbon-substituted succinic anhydride is prepared by chlorinating a polyisobutene having a number average molecular weight of 1000 to a chlorine content of 4.5% and then heating the chlorinated polyisobutene with 1.2 molar proportions of maleic anhydride at a temperature of 150°-220° C. A mixture of 874 grams (1 mole) of the succinic anhydride and 104 grams (1 mole) of neopentyl glycol is maintained at 240°-250°C./30 mm for 12 hours. The residue is a mixture of the esters resulting from the esterification of one and both hydroxy groups of the glycol.

Example D-2

The dimethyl ester of the substantially hydrocarbon-substituted succinic anhydride of Example D-1 is prepared by heating a mixture of 2185 grams of the anhydride, 480 grams of methanol, and 1000 cc of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm to remove volatile components. The residue is the desired dimethyl ester.

Example D-3

A substantially hydrocarbon-substituted succinic anhydride prepared as in Example D-1 is partially esterified with an ether-alcohol as follows. A mixture of 550 grams (0.63 mole) of the anhydride and 190 grams (0.32 mole) of a commercial polyethylene glycol having a molecular weight of 600 is heated at 240°-250° C. for 8 hours at atmospheric pressure and 12 hours at a pressure of 30 mm.Hg until the acid number of the reaction mixture is reduced to about 28. The residue is the desired ester.

Example D-4

A mixture of 926 grams of a polyisobutene-substituted succinic anhydride having an acid number of 121, 1023 grams of mineral oil, and 124 grams (2 moles per mole of the anhydride) of ethylene glycol is heated at 50°-170° C. while hydrogen chloride is bubbled through the reaction mixture for 1.5 hours. The mixture is then heated to 250° C./30 mm and the residue is purified by washing with aqueous sodium hydroxide followed by washing with water, then dried and filtered. The filtrate is a 50% oil solution of the desired ester.

Example D-5

A mixture of 438 grams of the polyisobutene-substituted succinic anhydride prepared as is described in Example D-1 and 333 grams of a commercial polybutylene glycol having a molecular weight of 1000 is heated for 10 hours at 150°-160° C. The residue is the desired ester.

Example D-6

A mixture of 645 grams of the substantially hydrocarbon-substituted succinic anhydride prepared as is described in Example D-1 and 44 grams of tetramethylene glycol is heated at 100°-130° C. for 2 hours. To this mixture there is added 51 grams of acetic anhydride (esterification catalyst) and the resulting mixture is heated under reflux at 130°-160° C. for 2.5 hours. Thereafter the volatile components of the mixture are distilled by heating the mixture to 196°-270° C./30 mm and then at 240° C./0.15 mm for 10 hours. The residue is the desired ester.

Example D-7

A mixture of 456 grams of a polyisobutene-substituted succinic anhydride prepared as is described in Example D-1 and 350 grams (0.35 mole) of the monophenyl ether of a polyethylene glycol having a molecular weight of 1000 is heated at 150°-155° C. for 2 hours. The product is the desired ester.

Example D-8

A dioleyl ester is prepared as follows: a mixture of 1 mole of a polyisobutene-substituted succinic anhydride prepared as in Example D-1, 2 moles of a commercial oleyl alcohol, 305 grams of xylene, and 5 grams of p-toluene sulfonic acid (esterification catalyst) is heated at 150°-173° C. for 4 hours whereupon 18 grams of water is collected as the distillate. The residue is washed with water and the organic layer dried and filtered. The filtrate is heated to 175° C./20 mm and the residue is the desired ester.

Example D-9

An ether-alcohol is prepared by the reaction of 9 moles of ethylene oxide with 0.9 mole of a polyisobutene-substituted phenol in which the polyisobutene substituent has a number average molecular weight of 1000. A substantially hydrocarbon-substituted succinic acid ester of this ether-alcohol is prepared by heating a xylene solution of an equimolar mixture of the two reactants in the presence of a catalytic amount of p-toluene sulfonic acid at 157° C.

Example D-10

A substantially hydrocarbon-substituted succinic anhydride is prepared as is described in Example D-1 except that a copolymer of 93 weight percent of isobutene and 10 weight percent of piperylene having a number average molecular weight of 66,000 is used in lieu of the polyisobutene. The anhydride has an acid number of about 22. An ester is prepared by heating a toluene solution of an equimolar mixture of the above anhydride and a commercial alkanol consisting substantially of $C_{12-14}$ alcohols at the reflux temperature for 7 hours while water is removed by azeotropic distillation. The residue is heated at 150° C./3 mm to remove volatile components and diluted with mineral oil. A 50% oil solution of the ester is obtained.

Example D-11

A mixture of 3225 parts (5.0 equivalents) of a polyisobutene-substituted succinic acylating agent prepared as in Example 2, 289 parts (8.5 equivalents) of pentaerythritol and 5204 parts of mineral oil is heated at 224°-235° C. for 5.5 hours. The reaction mixture is filtered at 130° C. to yield an oil solution of the desired product.

The carboxylic ester derivatives which are described above resulting from the reaction of (D-1) an acylating agent with (D-2) at least one hydroxy-containing compound such as an alcohol or a phenol of Formula X may be further reacted with (D-3) at least one amine, and particularly at least one polyamine in the manner described previously for the reaction of the acylating agent (B-1) with amines (B-2) in preparing component (B). Any of the amino compounds identified above as (B-2) can be used as amine (D-3). In one embodiment, the amount of amine (D-3) which is reacted with the ester is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the amine-modified carboxylic acid esters utilized as component (D) are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent (D-1) may be reacted simultaneously with both the alcohol (D-2) and the amine (D-3). There is generally at least about 0.01 equivalent of the alcohol and at least 0.01 equivalent of the amine although the total amount of equivalents of the combination should be at least about 0.5 equivalent per equivalent of acylating agent. The amine-modified carboxylic ester derivative compositions which are useful as component (D) are known in the art, and the preparation of a number of these derivatives is described in, for example, U.S. Pat. Nos. 3,957,854 and 4,234,435 which are hereby incorporated by reference. The following specific examples illustrate the preparation of the esters wherein both alcohols and amines are reacted with the acylating agent.

Example D-12

A mixture of 334 parts (0.52 equivalent) of a polyisobutene-substituted succinic acylating agent prepared as in Example D-2, 548 parts of mineral oil, 30 parts (0.88 equivalent) of pentaerythritol and 8.6 parts (0.0057 equivalent) of Polyglycol 112-2 demulsifier from Dow Chemical Company is heated at 150° C. for 2.5 hours. The reaction mixture is heated to 210° C. in 5 hours and held at 210° C. for 3.2 hours. The reaction mixture is cooled to 190° C. and 8.5 parts (0.2 equivalent) of a commercial mixture of ethylene polyamines having an average of about 3 to about 10 nitrogen atoms per molecule are added. The reaction mixture is stripped by heating at 205° C. with nitrogen blowing for 3 hours, then filtered to yield the filtrate as an oil solution of the desired product.

Example D-13

A mixture is prepared by the addition of 14 parts of aminopropyl diethanolamine to 867 parts of the oil solution of the product prepared in Example D-11 at 190°-200° C. The reaction mixture is held at 195° C. for 2.25 hours, then cooled to 120° C. and filtered. The filtrate is an oil solution of the desired product.

Example D-14

A mixture is prepared by the addition of 7.5 parts of piperazine to 867 parts of the oil solution of the product prepared in Example D-11 at 190° C. The reaction mixture is heated at 190°-205° C. for 2 hours, then cooled to 130° C. and filtered. The filtrate is an oil solution of the desired product.

Example D-15

A mixture of 322 parts (0.5 equivalent) of a polyisobutene-substituted succinic acylating agent prepared as in Example D-2, 68 parts (2.0 equivalents) of pentaerythritol and 508 parts of mineral oil is heated at 204°-227° C. for 5 hours. The reaction mixture is cooled to 162° C. and 5.3 parts (0.13 equivalent) of a commercial ethylene polyamine mixture having an average of about 3 to 10 nitrogen atoms per molecule is added. The reaction mixture is heated at 162°-163° C. for one hour, then cooled to 130° C. and filtered. The filtrate is an oil solution of the desired product.

Example D-16

The procedure for Example D-15 is repeated except the 5.3 parts (0.13 equivalent) of ethylene polyamine is replaced by 21 parts (0.175 equivalent) of tris(hydroxymethyl)aminomethane.

Example D-17

A mixture of 1480 parts of a polyisobutene-substituted succinic acylating agent prepared as in Example D-6, 115 parts (0.53 equivalent) of a commercial mixture of $C_{12-18}$ straight-chain primary alcohols, 87 parts (0.594 equivalent) of a commercial mixture of $C_{8-10}$ straight-chain primary alcohols, 1098 parts of mineral oil and 400 parts of toluene is heated to 120° C. At 120° C., 1.5 parts of sulfuric acid are added and the reaction mixture is heated to 160° C. and held for 3 hours. To the reaction mixture are then added 158 parts (2.0 equivalents) of n-butanol and 1.5 parts of sulfuric acid. The reaction mixture is heated at 160° C. for 15 hours, and 12.6 parts (0.088 equivalent) of aminopropyl morpholine are added. The reaction mixture is held at 160° C. for an additional 6 hours, stripped at 150° C. under vacuum and filtered to yield an oil solution of the desired product.

Example D-18

A mixture of 1869 parts of a polyisobutenyl-substituted succinic anhydride having an equivalent weight of about 540 (prepared by reacting chlorinated polyisobutene characterized by a number average molecular weight of 1000 and a chlorine content of 4.3%), an equimolar quantity of maleic anhydride and 67 parts of diluent oil is heated to 90° C. while blowing nitrogen gas through the mass. Then a mixture of 132 parts of a polyethylenepolyamine mixture having an average composition corresponding to that of tetraethylene pentamine and characterized by a nitrogen content of about 36.9% and an equivalent weight of about 38, and 33 parts of a triol demulsifier is added to the preheated oil and acylating agent over a period of about 0.5 hour. The triol demulsifier has a number average molecular weight of about 4800 and is prepared by reacting propylene oxide with glycerol and thereafter reacting that product with ethylene oxide to form a product where $—CH_2CH_2O—$ groups make up about 18% by weight of the demulsifier's average molecular weight. An exothermic reaction takes place causing the temperature to rise to about 120° C. Thereafter the mixture is heated to 170° C. and maintained at that temperature for about 4.5 hours. Additional oil (666 parts) is added and the product filtered. The filtrate is an oil solution of a desired ester-containing composition.

Example D-19

(a) A mixture comprising 1885 parts (3.64 equivalents) of the acylating agent described in Example D-18, 248 parts (7.28 equivalents) of pentaerythritol, and 64 parts (0.03 equivalent) of a polyoxyalkylene diol demulsifier having a number average molecular weight of about 3800 and consisting essentially of a hydrophobic base of $$—CH(CH_3)CH_2O—$$

units with hydrophylic terminal portions of $—CH_2CH_2O—$ units, the latter comprising approximately 10% by weight of the demulsifier are heated from room temperature to 200° C. over a one hour period while blowing the mass with nitrogen gas. The mass is then maintained at a temperature of about 200°-210° C. for an additional period of about 8 hours while continuing the nitrogen blowing.

(b) To the ester-containing composition produced according to (a) above, there are added over a 0.3 hour period (while maintaining a temperature of 200°-210° C. and nitrogen blowing) 39 parts (0.95 equivalent) of a polyethylenepolyamine mixture having an equivalent weight of about 41.2. The resulting mass is then maintained at a temperature of about 206°-210° C. for 2 hours during which time the nitrogen blowing is continued. Subsequently, 1800 parts of low viscosity mineral oil are added as a diluent and the resulting mass filtered at a temperature of about 110°-130° C. The filtrate is a 45% oil solution of the desired ester-containing composition.

Example D-20

(a) An ester-containing composition is prepared by heating a mixture of 3215 parts (6.2 equivalents) of a polyisobutenyl-substituted succinic anhydride as described in Example D-18, 422 parts (12.4 equivalents) of pentaerythritol, 55 parts (0.029 equivalent) of the polyoxyalkylene diol described in Example D-19, and 55 parts (0.034 equivalent) of a triol demulsifier having a number average molecular weight of about 4800 prepared by first reacting propylene oxide with glycerol and thereafter reacting that product with ethylene oxide to produce a product where $—CH_2CH_2O—$ groups make up about 18% by weight of the demulsifiers average molecular weight to a temperature of about 200°-210° C. with nitrogen blowing for about 6 hours. The resulting reaction mixture is an ester-containing composition.

(b) Subsequently, 67 parts (1.63 equivalents) of a polyethylenepolyamine mixture having an equivalent weight of about 41.2 are added to the composition produced according to (a) over a 0.6 hour period while maintaining a temperature of about 200°-210° C. with nitrogen blowing. The resulting mass is then heated an additional 2 hours at a temperature of about 207°-215° C., with continued nitrogen blowing and subsequently 2950 parts of low viscosity mineral diluent oil are added to the reaction mass. Upon filtration, there is obtained a 45% oil solution of an ester- and amine-containing composition.

Example D-21

(a) A mixture comprising 3204 parts (6.18 equivalents) of the acylating agent of Example D-18 above, 422 parts (12.41 equivalents) of pentaerythritol, 109 parts (0.068 equivalent) of the triol of Example D-20 (a) is heated to 200° C. over a 1.5 hour period with nitrogen blowing and thereafter maintained between 200°-212° C. for 2.75 hours with continued nitrogen blowing.

(b) Subsequently, there are added to the ester-containing composition produced according to (a) above, 67 parts (1.61 equivalents) of a polyethylene polyamine mixture having an equivalent weight of about 41.2. This mass is maintained at a temperature of about 210°-215° C. for about one hour. A low viscosity mineral diluent oil (3070 parts) is added to the mass, and this material is filtered at a temperature of about 120° C. The filtrate is a 45% oil solution of an amine-modified carboxylic ester.

Example D-22

A mixture of 1000 parts of polyisobutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°-190° C. The mixture then is blown with nitrogen at this temperature for several hours, and the residue is the desired polyisobutene-substituted succinic acylating agent.

A solution of 1000 parts of the acylating agent preparation described above in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

Example D-23

A mixture of 1000 parts (0.495 mole) of polyisobutene having a number average molecular weight of 2020 and a weight average molecular weight of 6049 and 115 parts (1.17 moles) of maleic anhydride is heated to 184° C. over 6 hours, during which time 85 parts (1.2 moles) of chlorine are added beneath the surface. An additional 59 parts (0.83 mole) of chlorine are added over 4 hours at 184°-189° C. The mixture is blown with nitrogen at 186°-190° C. for 26 hours. The residue is a polyisobutene-substituted succinic anhydride having a total acid number of 95.3.

A solution of 409 parts (0.66 equivalent) of the substituted succinic anhydride in 191 parts of mineral oil is heated to 150° C. and 42.5 parts (1.19 equivalent) of pentaerythritol are added over 10 minutes, with stirring, at 145°-150° C. The mixture is blown with nitrogen and heated to 205°-210° C. over about 14 hours to yield an oil solution of the desired polyester intermediate.

Diethylene triamine, 4.74 parts (0.138 equivalent), is added over one-half hour at 160° C. with stirring, to 988 parts of the polyester intermediate (containing 0.69 equivalent of substituted succinic actylating agent and 1.24 equivalents of pentaerythritol). Stirring is continued at 160° C. for one hour, after which 289 parts of mineral oil are added. The mixture is heated for 16 hours at 135° C. and filtered at the same temperature, using a filter aid material. The filtrate is a 35% solution is mineral oil of the desired amine-modified polyester. It has a nitrogen content of 0.16% and a residual acid number of 2.0.

Example D-24

Following the procedure of Example D-23, 988 parts of the polyester intermediate of that example are reacted with 5 parts (0.138 equivalent) of triethylene tetramine. The product is diluted with 290 parts of mineral oil to yield at 35% solution of the desired amine-modified polyester. It contains 0.15% nitrogen and has a residual acid number of 2.7.

Example D-25

Pentaerythritol, 42.5 parts (1.19 equivalents) is added over 5 minutes at 150° C. to a solution in 208 parts of mineral oil of 448 parts (0.7 equivalent) of a polyisobutene-substituted succinic anhydride similar to that of Example D-23 but having a total acid number of 92. The mixture is heated to 205° C. over 10 hours and blown with nitrogen for 6 hours at 205°-210° C. It is then diluted with 384 parts of mineral oil and cooled to 165° C., and 5.89 parts (0.14 equivalent) of a commercial ethylene polyamine mixture containing an average of 3-7 nitrogen atoms per molecule are added over 30 minutes at 155°-160° C. Nitrogen blowing is continued for one hour, after which the mixture is diluted with an additional 304 parts of oil. Mixing is continued at 130°-135° C. for 15 hours after which the mixture is cooled and filtered using a filter aid material. The filtrate is a 35% solution in mineral oil of the desired amine-modified polyester. It contains 0.147% nitrogen and has a residual acid number of 2.07.

Example D-26

A solution of 417 parts (0.7 equivalent) of a polyisobutene-substituted succinic anhydride prepared as in Example D-23 in 194 parts of mineral oil is heated to 53° C. and 42.8 parts (1.26 equivalents) of pentaerythritol are added. The mixture is heated at 153°-228° C. for about 6 hours. It is then cooled to 170° C. and diluted with 375 parts of mineral oil. It is further cooled to 156°-158° C. and 5.9 parts (0.14 equivalent) of the ethylene polyamine mixture of Example D-25 are added over one-half hour. The mixture is stirred at 158°-160° C. for one hour and diluted with an additional 295 parts of mineral oil. It is blown with nitrogen at 135° C. for 16 hours and filtered at 135° C. using a filter aid material. The filtrate is the desired 35% solution in mineral oil of the amine-modified polyester. It contains 0.16% nitrogen and has a total acid number of 2.0.

Example D-27

Following substantially the procedure of Example D-26, a product is prepared from 421 parts (0.7 equivalent) of a polyisobutene-substituted succinic anhydride having a total acid number of 93.2, 43 parts (1.26 equivalents) of pentaerythritol and 7.6 parts (0.18 equivalent) of the commercial ethylene polyamine mixture. The initial oil charge is 196 parts and subsequent charges are 372 and 296 parts. The product (a 35% solution in mineral oil) contains 0.2% nitrogen and has a residual acid number of 2.0.

The amount of the above carboxylic esters and amine-modified esters included in the lubricating oil compositions of this invention may vary from about 0 to about 10% by weight, more particularly from about 0.1 to about 5% by weight, based on the weight of the total oil composition.

(E) Neutral and Basic Alkaline Earth Metal Salts

The lubricating oil compositions of the present invention also may contain at least one neutral or basic alkaline earth metal salt of at least one acidic organic compound. Such salt compounds generally are referred to as ash-containing detergents. The acidic organic compound may be at least one sulfur acid, carboxylic acid, phosphorus acid, or phenol, or mixtures thereof.

Calcium, magnesium, barium and strontium are the preferred alkaline earth metals. Salts containing a mixture of ions of two or more of these alkaline earth metals can be used.

The salts which are useful as component (E) can be neutral or basic. The neutral salts contain an amount of alkaline earth metal which is just sufficient to neutralize the acidic groups present in the salt anion, and the basic salts contain an excess of the alkaline earth metal cation. Generally, the basic or overbased salts are preferred. The basic or overbased salts will have metal ratios of up to about 40 and more particularly from about 2 to about 30 or 40.

A commonly employed method for preparing the basic (or overbased) salts comprises heating a mineral oil solution of the acid with a stoichiometric excess of a metal neutralizing agent, e.g., a metal oxide, hydroxide, carbonate, bicarbonate, sulfide, etc., at temperatures above about 50° C. In addition, various promoters may be used in the overbasing process to aid in the incorporation of the large excess of metal. These promoters include such compounds as the phenolic substances, e.g., phenol, naphthol, alkylphenol, thiophenol, sulfurized alkylphenol and the various condensation products of formaldehyde with a phenolic substance; alcohols such as methanol, 2-propanol, octyl alcohol, cellosolve carbitol, ethylene, glycol, stearyl alcohol, and cyclohexyl alcohol; amines such as aniline, phenylenediamine, phenothiazine, phenyl-beta-naphthylamine, and dodecyl amine, etc. A particularly effective process for preparing the basic barium salts comprises mixing the acid with an excess of barium in the presence of the phenolic promoter and a small amount of water and carbonating the mixture at an elevated temperature, e.g., 60° C. to about 200° C.

As mentioned above, the acidic organic compound from which the salt of component (E) is derived may be at least one sulfur acid, carboxylic acid, phosphorus acid, or phenol or mixtures thereof. The sulfur acids may be sulfonic acids, thiosulfonic, sulfinic, sulfenic, partial ester sulfuric, sulfurous and thiosulfuric acids.

The sulfonic acids which are useful in preparing component (E) include those represented by the formulae $$R_xT(SO_3H)_y \quad (X)$$

and $$R'(SO_3H)_r \quad (XI)$$

In these formulae, R' is an aliphatic or aliphatic-substituted cycloaliphatic hydrocarbon or essentially hydrocarbon group free from acetylenic unsaturation and containing up to about 60 carbon atoms. When R' is aliphatic, it usually contains at least about 15 carbon atoms; when it is an aliphatic-substituted cycloaliphatic group, the aliphatic substituents usually contain a total of at least about 12 carbon atoms. Examples of R' are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of R' are cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing about 2-8 carbon atoms per olefinic monomer unit. R' can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

R in Formula X is generally a hydrocarbon or essentially hydrocarbon group free from acetylenic unsaturation and containing from about 4 to about 60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, any non-carbon atoms present in R' or R do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1-3. The subscripts r and y have an average value of about 1-2 per molecule and are generally 1.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the salts (E). It is to be understood that such examples serve also to illustrate the salts of such sulfonic acids useful as component (E). In other words, for every sulfonic acid enumerated, it is intended that the corresponding basic alkali metal salts thereof are also understood to be illustrated. (The same applies to the lists of other acid materials listed below.) Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of monoand didodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts which can be incorporated into the lubricating oil compositions of this invention as component (E), and techniques for making them can be found in the following U.S. Pat. Nos. 2,174,110; 2,202,781; 2,239,974; 2,319,121; 2,337,552; 3,488,284; 3,595,790; and 3,798,012. These are hereby incorporated by reference for their disclosures in this regard.

Suitable carboxylic acids from which useful alkaline earth metal salts (E) can be prepared include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyl-octahydroindenecarboxylic acid, palmitic acid, alkyl- and alkenylsuccinic acids, acids formed by oxidation of petrolatum or of hydrocarbon waxes, and commercially available mixtures of two or more carboxylic acids such as tall oil acids, rosin acids, and the like.

The equivalent weight of the acidic organic compound is its molecular weight divided by the number of acidic groups (i.e., sulfonic acid or carboxy groups) present per molecule.

The pentavalent phosphorus acids useful in the preparation of component (E) may be represented by the formula

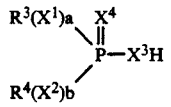

wherein each of $R^3$ and $R^4$ is hydrogen or a hydrocarbon or essentially hydrocarbon group preferably having from about 4 to about 25 carbon atoms, at least one of $R^3$ and $R^4$ being hydrocarbon or essentially hydrocarbon; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

The phosphorus acids may be those of the formula

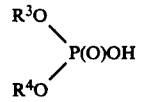

wherein $R^3$ is a phenyl group or (preferably) an alkyl group having up to 18 carbon atoms, and $R^4$ is hydrogen or a similar phenyl or alkyl group. Mixtures of such phosphorus acids are often preferred because of their ease of preparation.

Component (E) may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecylphenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formaldehyde-yielding reagents are especially preferred.

The equivalent weight of the acidic organic compound is its molecular weight divided by the number of acidic groups (i.e., sulfonic acid or carboxy groups) present per molecule.

In one embodiment, overbased alkaline earth salts of organic acidic compounds are preferred. Salts having metal ratios of at least about 2 and more generally from about 2 to about 40, more preferably up to about 20 are useful.

The amount of component (E) included in the lubricants of the present invention also may be varied over a wide range, and useful amounts in any particular lubricating oil composition can be readily determined by one skilled in the art. Component (E) functions as an auxiliary or supplemental detergent. The amount of component (E) contained in a lubricant of the invention may vary from about 0% or 0.01% to about 5% or more by weight.

The following examples illustrate the preparation of neutral and basic alkaline earth metal salts useful as component (E).

Example E-1

A mixture of 906 parts of an oil solution of an alkyl phenyl sulfonic acid (having a number average molecular weight of 450, 564 parts mineral oil, 600 parts toluene, 98.7 parts magnesium oxide and 120 parts water is blown with carbon dioxide at a temperature of 78°-85° C. for 7 hours at a rate of about 3 cubic feet of carbon dioxide per hour. The reaction mixture is constantly agitated throughout the carbonation. After carbonation, the reaction mixture is stripped to 165° C./20 tor and the residue filtered. The filtrate is an oil solution (34% oil) of the desired overbased magnesium sulfonate having a metal ratio of about 3.

Example E-2

A polyisobutenyl succinic anhydride is prepared by reacting a chlorinated poly(isobutene) (having an average chlorine content of 4.3% and derived from a polyisobutene having a number average molecular weight of about 1150) with maleic anhydride at about 200° C. To a mixture of 1246 parts of this succinic anhydride and 1000 parts of toluene there is added at 25° C., 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate containing the desired product.

Example E-3

A basic calcium sulfonate having a metal ratio of about 15 is prepared by carbonation, in increments, of a mixture of calcium hydroxide, a neutral sodium petroleum sulfonate, calcium chloride, methanol and an alkyl phenol.

Example E-4

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added 1000 parts of an alkyl phenyl sulfonic acid having a number average molecular weight of 500 with mixing. The mixture then is blown with carbon dioxide at a temperature of about 50° C. at the rate of about 5.4 pounds per hour for about 2.5 hours. After carbonation, 102 additional parts of oil are added and the mixture is stripped of volatile materials at a temperature of about 150°-155° C. at 55 mm. pressure. The residue is filtered and the filtrate is the desired oil solution of the overbased calcium sulfonate having calcium content of about 3.7% and a metal ratio of about 1.7.

Example E-5

A mixture of 490 parts (by weight) of a mineral oil, 110 parts of water, 61 parts of heptylphenol, 340 parts of barium mahogany sulfonate, and 227 parts of barium oxide is heated at 100° C. for 0.5 hour and then to 150° C. Carbon dioxide is then bubbled into the mixture until the mixture is substantially neutral. The mixture is filtered and the filtrate found to have a sulfate ash content of 25%.

Example E-6

A polyisobutene having a number average molecular weight of 50,000 is mixed with 10% by weight of phosphorus pentasulfide at 200° C. for 6 hours. The resulting product is hydrolyzed by treatment with steam at 160° C. to produce an acidic intermediate. The acidic intermediate is then converted to a basic salt by mixing with twice its volume of mineral oil, 2 moles of barium hydroxide and 0.7 mole of phenol and carbonating the mixture at 150° C. to produce a fluid product.

The lubricating oil compositions of the present invention also may contain, and preferably do contain, at least one friction modifier to provide the lubricating oil with the proper frictional characteristics. Various amines, particularly tertiary amines are effective friction modifiers. Examples of tertiary amine friction modifiers include N-fatty alkyl-N,N-diethanolamines, N-fatty alkyl-N,N-diethoxy ethanol amines, etc. Such tertiary amines can be prepared by reacting a fatty alkyl amine with an appropriate number of moles of ethylene oxide. Tertiary amines derived from naturally occurring substances such as coconut oil and oleoamine are available from Armour Chemical Company under the trade designation "Ethomeen". Particular examples are the Ethomeen-C and the Ethomeen-O series.

Sulfur-containing compounds such as sulfurized $C_{12-24}$ fats, alkyl sulfides and polysulfides wherein the alkyl groups contain from 1 to 8 carbon atoms, and sulfurized polyolefins also may function as friction modifiers in the lubricating oil compositions of the invention.

(F) Partial Fatty Acid Ester of Polyhydric Alcohols

In one embodiment, a preferred friction modifier to be included in the lubricating oil compositions of the present invention is at least one partial fatty acid ester of a polyhydric alcohol, and generally, from about 0.01 up to about 1% or 2% by weight of the partial fatty acid esters appears to provide the desired friction modifying characteristics. The hydroxy fatty acid esters are selected from hydroxy fatty acid esters of dihydric or polyhydric alcohols or oil soluble oxyalkylenated derivatives thereof.

The term "fatty acid" as used in the specification and claims refers to acids which may be obtained by the hydrolysis of a naturally occurring vegetable or animal fat or oil. These acids usually contain from about 8 to about 22 carbon atoms and include, for example, caprylic acid, caproic acid, palmitic acid, stearic acid, oleic acid, linoleic acid, etc. Acids containing from 10 to 22 carbon atoms generally are preferred, and in some embodiments, those acids containing from 16 to 18 carbon atoms are especially preferred.

The polyhydric alcohols which can be utilized in the preparation of the partial fatty acids contain from 2 to about 8 or 10 hydroxyl groups, more generally from about 2 to about 4 hydroxyl groups. Examples of suitable polyhydric alcohols include ethylene glycol, propylene glycol, neopentylene glycol, glycerol, pentaerythritol, etc. Ethylene glycol and glycerol are preferred. Polyhydric alcohols containing lower alkoxy groups such as methoxy and/or ethoxy groups may be utilized in the preparation of the partial fatty acid esters.

Suitable partial fatty acid esters of polyhydric alcohols include, for example, glycol monoesters, glycerol mono- and diesters, and pentaerythritol di- and/or triesters. The partial fatty acid esters of glycerol are preferred, and of the glycerol esters, monoesters, or mixtures of monoesters and diesters are often utilized. The partial fatty acid esters of polyhydric alcohols can be prepared by methods well known in the art, such as by direct esterification of an acid with a polyol, reaction of a fatty acid with an epoxide, etc.

It is generally preferred that the partial fatty acid ester contain olefinic unsaturation, and this olefinic unsaturation usually is found in the acid moiety of the ester. In addition to natural fatty acids containing olefinic unsaturation such as oleic acid, octeneoic acids, tetradeceneoic acids, etc., can be utilized in forming the esters.

The partial fatty acid esters utilized as friction modifiers (component (F)) in the lubricating oil compositions of the present invention may be present as components of a mixture containing a variety of other components such as unreacted fatty acid, fully esterified polyhydric alcohols, and other materials. Commercially available partial fatty acid esters often are mixtures which contain one or more of these components as well as mixtures of mono- and diesters of glycerol.

One method for preparing monoglycerides of fatty acids from fats and oils is described in Birnbaum U.S. Pat. No. 2,875,221. The process described in this patent is a continuous process for reacting glycerol and fats to provide a product having a high proportion of monoglyceride. Among the commercially available glycerol esters are ester mixtures containing at least about 30% by weight of monoester and generally from about 35% to about 65% by weight of monoester, about 30% to about 50% by weight of diester, and the balance in the aggregate, generally less than about 15%, is a mixture of triester, free fatty acid and other components. Specific examples of commercially available material comprising fatty acid esters of glycerol include Emerest 2421 (Emery Industries, Inc.), Cap City GMO (Capital), DUR-EM 114, DUR-EM GMO, etc. (Durkee Industrial Foods, Inc.) and various materials identified under the mark MAZOL GMO (Mazer Chemicals, Inc.). Other examples of partial fatty acid esters of polyhydric alcohols may be found in K. S. Markley, Ed., "Fatty Acids", Second Edition, Parts I and V, Interscience Publishers (1968). Numerous commercially available fatty acid esters of polyhydric alcohols are listed by tradename and manufacturer in McCutcheons' Emulsifiers and Detergents, North American and International Combined Editions (1981).

The following example illustrates the preparation of a partial fatty acid ester of glycerol.

Example F-1

A mixture of glycerol oleates is prepared by reacting 882 parts of a high oleic-content sunflower oil which comprises about 80% oleic acid, about 10% linoleic acid and the balance saturated triglycerides, and 499 parts of glycerol in the presence of a catalyst prepared by dissolving potassium hydroxide in glycerol. The reaction is conducted by heating the mixture to 155° C. under a nitrogen sparge, and then heating under nitrogen for 13 hours at 155° C. The mixture is then cooled to less than 100° C., and 9.05 parts of 85% phosphoric acid are added to neutralize the catalyst. The neutralized reaction mixture is transferred to a 2-liter separatory funnel, and the lower layer is removed and discarded. The upper layer is the product which contains, by analysis, 56.9% by weight glycerol monooleate, 33.3% glycerol dioleate (primarily 1,2-) and 9.8% glycerol trioleate.

The present invention also contemplates the use of other additives in the lubricating oil compositions of the present invention. These other additives include such conventional additive types as antioxidants, extreme pressure agents, corrosion inhibiting agents, pour point depressants, color stabilizing agents, anti foam agents, and other such additive materials known generally to those skilled in the art of formulating lubricating oils.

(G) Neutral and Basic Salts of Phenol Sulfides

In one embodiment, the oils of the invention may contain at least one neutral or basic alkaline earth metal salt of an alkylphenol sulfide as a detergent and antioxidant. The oils may contain from about 0 to about 2 or 3% of said phenol sulfides. More often, the oil may contain from about 0.01 to about 2% by weight of the neutral or basic salts of phenol sulfides. The term "basic" is used herein the same way in which it was used in the definition of other components above, that is, it refers to salts having a metal ratio in excess of 1. The neutral and basic salts of phenol sulfides are detergents and antioxidants in the lubricating oil compositions of the invention, and these salts are particularly used in improving the performance of oils in Caterpillar testing.

The alkylphenols from which the sulfide salts are prepared generally comprise phenols containing hydrocarbon substituents with at least about 6 carbon atoms; the substituents may contain up to about 7000 aliphatic carbon atoms. Also included are substantially hydrocarbon substituents, as defined hereinabove. The preferred hydrocarbon substituents are derived from the polymerization of olefins such as ethylene, propene, 1-butene, isobutene, 1-hexene, 1-octene, 2-methyl-1-heptene, 2-butene, 2-pentene, 3-pentene and 4-octene. The hydrocarbon substituent may be introduced onto the phenol by mixing the hydrocarbon and the phenol at a temperature of about 50°–200° C. in the presence of a suitable catalyst such as aluminum trichloride, boron trifluoride, zinc chloride or the like. The substituent can also be introduced by other alkylation processes known in the art.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. The molar ratio of the phenol to the sulfur compound can be from about 1:0.5 to about 1:1.5, or higher. For example, phenol sulfides are readily obtained by mixing, at a temperature above about 60° C., one mole of an alkylphenol and 0.5–1.5 moles of sulfur dichloride. The reaction mixture is usually maintained at about 100° C. for about 2–5 hours, after which time the resulting sulfide is dried and filtered. When elemental sulfur is used, temperatures of about 200° C. or higher are sometimes desirable. It is also desirable that the drying operation be conducted under nitrogen or a similar inert gas.

The salts of phenol sulfides are conveniently prepared by reacting the phenol sulfide with a metal base, typically in the presence of a promoter such as those enumerated for the preparation of component (E). Temperatures and reaction conditions are similar for the preparation of the basic component (E) described above as useful in the lubricants of the present invention. Preferably, the basic salt is treated with carbon dioxide after it has been formed.

It is often preferred to use, as an additional promoter, a carboxylic acid containing about 1-100 carbon atoms or an alkali metal, alkaline earth metal, zinc or lead salt thereof. Especially preferred in this regard are the lower alkyl monocarboxylic acids including formic acid, acetic acid, propionic acid, butyric acid, isobutyric acid and the like. The amount of such acid or salt used is generally about 0.002-0.2 equivalent per equivalent of metal base used for formation of the basic salt.

In an alternative method for preparation of these basic salts, the alkylphenol is reacted simultaneously with sulfur and the metal base. The reaction should then be carried out at a temperature of at least about 150° C., preferably about 150°-200° C. It is frequently convenient to use as a solvent a compound which boils in this range, preferably a mono-(lower alkyl) ether of a polyethylene glycol such as diethylene glycol. The methyl and ethyl ethers of diethylene glycol, which are respectively sold under the trade names "Methyl Carbitol" and "Carbitol", are especially useful for this purpose.

Suitable basic alkyl phenol sulfides are disclosed, for example, in U.S. Pat. Nos. 3,372,116 and 3,410,798, which are hereby incorporated by reference.

The following examples illustrate methods for the preparation of these basic materials.

Example G-1

A phenol sulfide is prepared by reacting sulfur dichloride with a polyisobutenyl phenol in which the polyisobutenyl substituent has a number average molecular weight of about 350, in the presence of sodium acetate (an acid acceptor used to avoid discoloration of the product). A mixture of 1755 parts of this phenol sulfide, 500 parts of mineral oil, 335 parts of calcium hydroxide and 407 parts of methanol is heated to about 43°-50° C. and carbon dioxide is bubbled through the mixture for about 7.5 hours. The mixture is then heated to drive off volatile matter, an additional 422.5 parts of oil are added to provide a 60% solution in oil. This solution contains 5.6% calcium and 1.59% sulfur.

Example G-2

To 6072 parts (22 equivalents) of a tetrapropylene-substituted phenol (prepared by mixing, at 138° C. and in the presence of a sulfuric acid treated clay, phenol and tetrapropylene), there are added at 90°-95° C., 1134 parts (22 equivalents) of sulfur dichloride. The addition is made over a 4-hour period whereupon the mixture is bubbled with nitrogen for 2 hours heated to 150° C. and filtered. To 861 parts (3 equivalents) of the above product, 1068 parts of mineral oil, and 90 parts of water, there are added at 70° C., 122 parts (3.3 equivalents) of calcium hydroxide. The mixture is maintained at 110° C. for 2 hours, heated to 165° C. and maintained at this temperature until it is dry. Thereupon, the mixture is cooled to 25° C. and 180 parts of methanol are added. The mixture is heated to 50° C. and 366 parts (9.9 equivalents) of calcium hydroxide and 50 parts (0.633 equivalent) of calcium acetate are added. The mixture is agitated for 45 minutes and is then treated at 50°-70° C. with carbon dioxide at a rate of 2-5 cubic feet per hour for 3 hours. The mixture is dried at 165° C. and the residue is filtered. The filtrate has a calcium content of 8.8%, a neutralization number of 39 (basic) and a metal ratio of 4.4.

Example G-3

To 5880 parts (12 equivalents) of a polyisobutene-substituted phenol (prepared by mixing, at 54° C. and in the presence of boron trifluoride, equimolar amounts of phenol and a polyisobutene having a number average molecular weight of about 350) and 2186 parts of mineral oil, there are added over 2.5 hours and at 90°-110° C., 618 parts (12 equivalents) of sulfur dichloride. The mixture is heated to 150° C. and bubbled with nitrogen. To 3449 parts (5.25 equivalents) of the above product, 1200 parts of mineral oil, and 130 parts of water, there are added at 70° C., 147 parts (5.25 equivalents) of calcium oxide. The mixture is maintained at 95°-110° C. for 2 hours, heated to and maintained at 160° C. for one hour and then cooled to 60° C. whereupon 920 parts of 1-propanol, 307 parts (10.95 equivalents) of calcium oxide, and 46.3 parts (0.78 equivalent) of acetic acid are added. The mixture is then contacted with carbon dioxide at a rate of 2 cubic feet per hour for 2.5 hours. The mixture is dried at 190° C. and the residue is filtered to give the desired product.

Example G-4

A mixture of 485 parts (1 equivalent) of a polyisobutene-substituted phenol wherein the substituent has a number average molecular weight of about 400, 32 parts (1 equivalent) of sulfur, 111 parts (3 equivalents) of calcium hydroxide, 16 parts (0.2 equivalent) of calcium acetate, 485 parts of diethylene glycol monomethyl ether and 414 parts of mineral oil is heated at 120°-205° C. under nitrogen for 4 hours. Hydrogen sulfide evolution begins as the temperature rises above 125° C. The material is allowed to distil and hydrogen sulfide is absorbed in a sodium hydroxide solution. Heating is discontinued when no further hydrogen sulfide absorption is noted; the remaining volatile material is removed by distillation at 95° C./10 mm pressure. The distillation residue is filtered. The product thus obtained is a 60% solution of the desired product in mineral oil.

(H) Sulfurized Olefins

The oil compositions of the present invention also may contain (H) at least one sulfur-containing composition useful in improving the anti-wear, extreme pressure and antioxidant properties of the lubricating oil compositions. The oil compositions may contain from about 0.01 to about 2% by weight of the sulfurized olefins. Sulfur-containing compositions prepared by the sulfurization of olefins are useful. When included in the oil compositions of this invention, the oil composition typically will contain from about 0.01 to about 2% of the sulfurized olefin. The olefins may be any aliphatic, arylaliphatic or alicyclic olefinic hydrocarbon containing from about 3 to about 30 carbon atoms. The olefinic hydrocarbons contain at least one olefinic double bond, which is defined as a non-aromatic double bond; that is, one connecting two aliphatic carbon atoms. In its broadest sense, the olefinic hydrocarbon may be defined by the formula $$R^7R^8C{=}CR^9R^{10}$$

wherein each of $R^7$, $R^8$, $R^9$ and $R^{10}$ is hydrogen or a hydrocarbon (especially alkyl or alkenyl) radical. Any two of $R^7$, $R^8$, $R^9$, $R^{10}$ may also together form an alkylene or substituted alkylene group; i.e., the olefinic compound may be alicyclic.

Monoolefinic and diolefinic compounds, particularly the former, are preferred, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3–20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3–3.0 gram-atoms and about 0.1–1.5 moles. The preferred ranges are about 0.5–2.0 gram-atoms and about 0.5–1.25 moles respectively, and the most desirable ranges are about 1.2–1.8 gram-atoms and about 0.4–0.8 mole respectively.

The temperature range in which the sulfurization reaction is carried out is generally about 50°–350° C. The preferred range is about 100°–200° C., with about 125°–180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.01–2.0% of the weight of the olefinic compound. In the case of the preferred ammonia and amine catalysts, about 0.0005–0.5 mole per mole of olefin is preferred, and about 0.001–0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of component (H) is the treatment of the sulfurized product, obtained as described hereinabove, to reduce active sulfur. An illustrative method is treatment with an alkali metal sulfide. Other optional treatments may be employed to remove insoluble by-products and improve such qualities as the odor, color and staining characteristics of the sulfurized compositions.

U.S. Pat. No. 4,119,549 is incorporated by reference herein for its disclosure of suitable sulfurized olefins useful in the lubricating oils of the present invention. Several specific sulfurized compositions are described in the working examples thereof. The following examples illustrate the preparation of two such compositions.

Example H-1

Sulfur (629 parts, 19.6 moles) is charged to a jacketed high-pressure reactor which is fitted with agitator and internal cooling coils. Refrigerated brine is circulated through the coils to cool the reactor prior to the introduction of the gaseous reactants. After sealing the reactor, evacuating to about 6 torr and cooling, 1100 parts (9.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

Example H-2

Following substantially the procedure of Example H-1, 773 parts of diisobutene are reacted with 428.6 parts of sulfur and 143.6 parts of hydrogen sulfide in the presence of 2.6 parts of n-butylamine, under autogenous pressure at a temperature of about 150°–155° C. Volatile materials are removed and the sulfurized product is recovered as a liquid.

Sulfur-containing compositions characterized by the presence of at least one cycloaliphatic group with at least two nuclear carbon atoms of one cycloaliphatic group or two nuclear carbon atoms of different cycloaliphatic groups joined together through a divalent sulfur linkage also are useful in component (H) in the lubricating oil compositions of the present invention. These types of sulfur compounds are described in, for example, reissue U.S. Pat. Re No. 27,331, the disclosure which is hereby incorporated by reference. The sulfur linkage contains at least two sulfur atoms, and sulfurized Diels-Alder adducts are illustrative of such compositions.

In general, the sulfurized Diels-Alder adducts are prepared by reacting sulfur with at least one Diels-Alder adduct at a temperature within the range of from about 110° C. to just below the decomposition temperature of the adduct. The molar ratio of sulfur to adduct is generally from about 0.5:1 to about 10:1. The Diels-Alder adducts are prepared by known techniques by reacting a conjugated diene with an ethylenically or acetylenically unsaturated compound (dienophile). Examples of conjugated dienes include isoprene, methylisoprene, chloroprene, and 1,3-butadiene. Examples of suitable ethylenically unsaturated compounds include alkyl acrylates such as butyl acrylate and butyl methacrylate. In view of the extensive discussion in the prior art of the preparation of various sulfurized Diels- Alder adducts, it is believed unnecessary to lengthen this application by incorporating any further discussion of the preparation of such sulfurized products. The following examples illustrate the preparation of two such compositions.

Example H-3

(a) A mixture comprising 400 grams of toluene and 66.7 grams of aluminum chloride is charged to a two-liter flask fitted with a stirrer, nitrogen inlet tube, and a solid carbon dioxide-cooled reflux condenser. A second mixture comprising 640 grams (5 moles) of butylacrylate and 240.8 grams of toluene is added to the $AlCl_3$ slurry over a 0.25-hour period while maintaining the temperature within the range of 37°-58° C. Thereafter, 313 grams (5.8 moles) of butadiene are added to the slurry over a 2.75-hour period while maintaining the temperature of the reaction mass at 60°-61° C. by means of external cooling. The reaction mass is blown with nitrogen for about 0.33-hour and then transferred to a four-liter separatory funnel and washed with a solution of 150 grams of concentrated hydrochloric acid in 1100 grams of water. Thereafter, the product is subjected to two additional water washings using 1000 ml of water for each wash. The washed reaction product is subsequently distilled to remove unreacted butylacrylate and toluene. The residue of this first distillation step is subjected to further distillation at a pressure of 9-10 millimeters of mercury whereupon 785 grams of the desired adduct are collected over the temperature of 105°-115° C.

(b) The above-prepared adduct of butadiene-butylacrylate (4550 grams, 25 moles) and 1600 grams (50 moles) of sulfur flowers are charged to a 12 liter flask, fitted with stirrer, reflux condenser, and nitrogen inlet tube. The reaction mixture is heated at a temperature within the range of 150°-155° C. for 7 hours while passing nitrogen therethrough at a rate of about 0.5 cubic feet per hour. After heating, the mass is permitted to cool to room temperature and filtered. The filtrate is the desired sulfur-containing product.

Example H-4

(a) An adduct of isoprene and acrylonitrile is prepared by mixing 136 grams of isoprene, 172 grams of methylacrylate, and 0.9 gram of hydroquinone (polymerization inhibitor) in a rocking autoclave and thereafter heating for 16 hours at a temperature within the range of 130°-140° C. The autoclave is vented and the contents decanted thereby producing 240 grams of a light yellow liquid. This liquid is stripped at a temperature of 90° C. and a pressure of 10 millimeters of mercury thereby yielding the desired liquid product as the residue.

(b) To 255 grams (1.65 moles) of the isoprenemethacrylate adduct of (a) heated to a temperature of 110°-120° C., there are added 53 grams (1.65 moles) of sulfur flowers over a 45-minute period. The heating is continued for 4.5 hours at a temperature in the range of 130°-160° C. After cooling to room temperature, the reaction mixture is filtered through a medium sintered glass funnel. The filtrate consists of 301 grams of the desired sulfur-containing products.

(c) In part (b) the ratio of sulfur to adduct is 1:1. In this example, the ratio is 5:1. Thus, 640 grams (20 moles) of sulfur flowers are heated in a three-liter flask at 170° C. for about 0.3 hour. Thereafter, 600 grams (4 moles) of the isoprene-methacrylate adduct of (a) are added dropwise to the molten sulfur while maintaining the temperature at 174°-198° C. Upon cooling to room temperature, the reaction mass is filtered as above, the filtrate being the desired product.

Other extreme pressure agents and corrosion- and oxidation-inhibiting agents also may be included and are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith Lezius-Hiles Co. publishers, Cleveland, Ohio, 1967.

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents" by Henry T. Kerner (Noyes Data Corporation, 1976), pages 125-162.

The lubricating oil compositions of the present invention also may contain, particularly when the lubricating oil compositions are formulated into multi-grade oils, one or more viscosity modifiers. Viscosity modifiers generally are polymeric materials characterized as being hydrocarbon-based polymers generally having number average molecular weights between about 25,000 and 500,000 more often between about 50,000 and 200,000.

Polyisobutylene has been used as a viscosity modifier in lubricating oils. Polymethacrylates (PMA) are prepared from mixtures of methacrylate monomers having different alkyl groups. Most PMA's are viscosity-modifiers as well as pour point depressants. The alkyl groups may be either straight chain or branched chain groups containing from 1 to about 18 carbon atoms.

When a small amount of a nitrogen-containing monomer is copolymerized with alkyl methacrylates, dispersancy properties also are incorporated into the product.

Thus, such a product has the multiple function of viscosity modification, pour point depressants and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity-modifiers.

Ethylene-propylene copolymers, generally referred to as OCP can be prepared by copolymerizing ethylene and propylene, generally in a solvent, using known catalysts such as a Ziegler- Natta initiator. The ratio of ethylene to propylene in the polymer influences the oil-solubility, oil-thickening ability, low temperature viscosity, pour point depressant capability and engine performance of the product. The common range of ethylene content is 45–60% by weight and typically is from 50% to about 55% by weight. Some commercial OCP's are terpolymers of ethylene, propylene and a small amount of non-conjugated diene such as 1,4-hexadiene. In the rubber industry, such terpolymers are referred to as EPDM (ethylene propylene diene monomer). The use of OCP's as viscosity-modifiers in lubricating oils has increased rapidly since about 1970, and the OCP's are currently one of the most widely used viscosity modifiers for motor oils.

Esters obtained by copolymerizing styrene and maleic anhydride in the presence of a free radical initiator and thereafter esterifying the copolymer with a mixture of $C_{4-18}$ alcohols also are useful as viscosity-modifying additives in motor oils. The styrene esters generally are considered to be multi-functional premium viscosity-modifiers. The styrene esters in addition to their viscosity-modifying properties also are pour point depressants and exhibit dispersancy properties when the esterification is terminated before its completion leaving some unreacted anhydride or carboxylic acid groups. These acid groups can then be converted to imides by reaction with a primary amine.

Hydrogenated styrene-conjugated diene copolymers are another class of commercially available viscosity-modifiers for motor oils. Examples of styrenes include styrene, alpha-methyl styrene, ortho-methyl styrene, meta-methyl styrene, para-methyl styrene, para-tertiary butyl styrene, etc. Preferably the conjugated diene contains from four to six carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight.

These copolymers can be prepared by methods well known in the art. Such copolymers usually are prepared by anionic polymerization using, for example, an alkali metal hydrocarbon (e.g., sec-butyllithium) as a polymerization catalyst. Other polymerization techniques such as emulsion polymerization can be used.

These copolymers are hydrogenated in solution so as to remove a substantial portion of their olefinic double bonds. Techniques for accomplishing this hydrogenation are well known to those of skill in the art and need not be described in detail at this point. Briefly, hydrogenation is accomplished by contacting the copolymers with hydrogen at super-atmospheric pressures in the presence of a metal catalyst such as colloidal nickel, palladium supported on charcoal, etc.

In general, it is preferred that these copolymers, for reasons of oxidative stability, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the afore-mentioned analytical techniques.

These copolymers typically have number average molecular weights in the range of about 30,000 to about 500,000, preferably about 50,000 to about 200,000. The weight average molecular weight for these copolymers is generally in the range of about 50,000 to about 500,000, preferably about 50,000 to about 300,000.

The above-described hydrogenated copolymers, and others have been described in the prior art such as in U.S. Pat. Nos. 3,551,336; 3,598,738; 3,554,911; 3,607,749; 3,687,849; and 4,181,618 which are hereby incorporated by reference for their disclosures of polymers and copolymers useful as viscosity improvers. For example, U.S. Pat. No. 3,554,911 describes a hydrogenated random butadiene-styrene copolymer, its preparation and hydrogenation. Hydrogenated styrene-butadiene copolymers useful as viscosity-modifiers in the lubricating oil compositions of the present invention are available commercially from, for example, BASF under the general trade designation "Glissoviscal". A particular example is a hydrogenated styrene-butadiene copolymer available under the designation Glissoviscal 5260 which has a number average molecular weight of about 120,000. Hydrogenated styrene-isoprene copolymers useful as viscosity modifiers are available from, for example, The Shell Chemical Company under the general trade designation "Shellvis". Shellvis 40 from Shell Chemical Company is identified as a diblock copolymer of styrene and isoprene having a number average molecular weight of about 155,000, a styrene content of about 19 mole percent and an isoprene content of about 81 mole percent. Shellvis 50 is available from Shell Chemical Company and is identified as a diblock copolymer of styrene and isoprene having a number average molecular weight of about 100,000, a styrene content of about 28 mole percent and an isoprene content of about 72 mole percent.

The amount of polymeric viscosity modifier incorporated in the lubricating oil compositions of the present invention may be varied over a wide range although lesser amounts than normal are employed in view of the ability of the carboxylic acid derivative component (B) (and certain of the carboxylic ester derivatives (E)) to function as a viscosity modifier in addition to functioning as a dispersant. In general, the amount of polymeric viscosity-improver included in the lubricating oil compositions of the invention may be as high as 10% by weight based on the weight of the finished lubricating oil. More often, the polymeric viscosity-improvers are used in concentrations of about 0.2 to about 8% and more particularly, in amounts from about 0.5 to about 6% by weight of the finished lubricating oil.

The lubricating oils of the present invention may be prepared by dissolving or suspending the various components directly in a base oil along with any other additives which may be used. More often, one or more of the chemical components of the present invention are diluted with a substantially inert, normally liquid organic diluent/solvent such as mineral oil, to form an additive concentrate. These concentrates usually comprise from about 10 to about 80% by weight of one or more of the Components (A) through (H) described above, and may contain, in addition, one or more of the other additives described above. Chemical concentrations such as 15%, 20%, 30% or 50% or higher may be employed. For example, concentrates may contain on a chemical basis, from about 10 to about 50% by weight of the carboxylic derivative composition (B), and from about 0.001 to about 15% by weight of the metal phosphorodithioate (C). The concentrates also may contain from about 1 to about 30% by weight of the carboxylic ester (D) and/or from about 1% to about 20% by weight of at least one neutral or basic alkaline earth metal salt (E), and/or from about 0.001 to about 10% by weight of at least one partial fatty acid ester of a polyhydric alcohol (F).

The following examples illustrate concentrates of the present invention. In the following examples of concentrates and lubricating oils, the percentages indicate the amount of the normally oil diluted solutions of the indicated additives used to form the lubricating oil composition. For example, Lubricant I contains 4.5% by volume of the product of Example B-20 which is an oil solution of the indicated carboxylic derivative (B) containing 55% diluent oil.

| | Parts by Wt. |
|---|---|
| Concentrate I | |
| Product of Example B-20 | 45 |
| Product of Example C-2 | 12 |
| Mineral Oil | 43 |
| Concentrate II | |
| Product of Example B-20 | 60 |
| Product of Example C-2 | 10 |
| Product of Example D-22 | 5 |
| Mineral Oil | 25 |
| Concentrate III | |
| Product of Example B-21 | 40 |
| Product of Example C-1 | 5 |
| Product of Example D-23 | 5 |
| Product of Example E-1 | 5 |
| Mineral Oil | 45 |

Typical lubricating oil compositions according to the present invention are exemplified in the following lubricating oil examples.

TABLE I

| | LUBRICANTS | | | | | |
|---|---|---|---|---|---|---|
| Components/Example (% vol) | I | II | III | IV | V | VI |
| Base Oil | (a) | (b) | (a) | (b) | (c) | (c) |
| Grade | 10W-30 | 5W-30 | 10W-30 | 10W-40 | 10W-30 | 30 |
| V.I. Type* | (l) | (l) | (l) | (m) | (l) | — |
| Product of Example B-20 | 4.5 | 4.5 | 5.0 | 6.5 | 6.5 | 6.5 |
| Product of Example C-1 | 1.25 | 1.25 | 0.75 | 0.75 | 0.75 | 0.75 |
| Product of Example C-18 (10% oil) | — | — | 0.06 | 0.06 | 0.06 | 0.06 |
| Product of Example D-22 | 1.50 | 1.40 | — | — | — | — |
| Basic magnesium alkylated benzene sulfonate (32% oil, MR of 14.7) | 0.20 | 0.20 | 0.20 | 0.20 | 0.20 | 0.20 |
| Product of Example E-1 | 0.45 | 0.45 | 0.45 | 0.45 | 0.45 | 0.45 |
| Basic calcium alkylated benzene sulfonate (48% oil, MR of 12) | 0.40 | 0.40 | 0.40 | 0.40 | 0.40 | 0.40 |
| Basic calcium phenol sulfide (38% oil, MR of 2.3) | 0.6 | 0.6 | — | 0.6 | — | — |
| Glycerol mono- and dioleate mixture** | — | 0.2 | — | — | 0.2 | — |
| Product of Example H-3 | — | — | — | — | — | 0.40 |
| Silicone anti-foam agent | 100 ppm | 100 ppm | 100 ppm | 100 ppm | 100 ppm | 100 ppm |

(a) Mid East Stock.
(b) North Sea Stock.
(c) Mid-Continent-hydrotreated.
(d) Mid-Continent-solvent refined.
(l) A diblock copolymer of styrene-isoprene; number average molecular weight of about 155,000.
(m) A polyisoprene, star polymer.
*The amount of polymeric VI included in each lubricant is an amount required to have the finished lubricant meet the requirements of the indicated multigrade.
**Emerest 2421.

TABLE II

| | LUBRICANTS | | | | |
|---|---|---|---|---|---|
| Components/Example (% vol) | VII | VIII | IX*** | X*** | XI*** |
| Base Oil | 65% 150N** 35% 600N** | (c)** | (c) | (c) | (c) |
| Grade | 15W-40 | 30 | 15W-40 | 15W-40 | 15W-40 |
| V.I. Type* | (l) | — | (l) | (l) | (l) |
| Product of Example B-20 | 4.47 | 4.47 | 5.0 | 4.6 | 5.2 |
| Product of Example C-1 | 1.20 | 1.20 | 1.5 | 1.54 | 1.5 |
| Product of Example D-22 | 1.39 | 1.39 | — | 1.41 | — |
| Basic magnesium alkylated benzene sulfonate (32% oil, MR of 15) | 0.44 | 0.44 | 0.6 | 0.56 | 0.4 |

TABLE II-continued

| Components/Example (% vol) | LUBRICANTS VII | VIII | IX*** | X*** | XI*** |
|---|---|---|---|---|---|
| Basic calcium alkylated benzene sulfonate (52% oil, MR of f12) | 0.97 | 0.97 | 1.2 | 1.24 | — |
| Basic magnesium alkylated benzene sulfonate (34% oil, MR of 3) | — | — | — | — | 0.75 |
| Basic calcium sulfur coupled phenol (38% oil, MR of 2.3) | — | — | — | — | 1.8 |
| Alkyl phenol reacted with sulfur dichloride (42% oil) | 2.34 | 2.34 | 2.5 | 2.48 | — |
| Nonyl phenoxy poly-(ethylenoxy)ethanol | — | — | — | 0.1 | — |
| $C_9$ mono- and dialkylated diphenyl amine (16% oil) | — | — | — | — | 0.1 |
| Pour Point Depressant | 0.2 | 0.2 | 0.2 | 0.2 | — |
| Silicone anti-foam agent | 100 ppm | 100 ppm | 100 ppm | 110 ppm | 100 ppm |

(l) A diblock copolymer of styrene-isoprene; number average molecular weight of about 155,000.
*The amount of polymeric VI included in each lubricant is an amount required to have the finished lubricant meet the requirements of the indicated multigrade.
**(High-sulfur stock).
***Amounts in these examples are on a % wt. basis.

| | % w |
|---|---|
| Example XII | |
| Product of Example B-1 | 6.2 |
| Product of Example C-1 | 1.5 |
| 100 Neutral Paraffinic Oil | remainder |
| Example XIII | |
| Product of Example B-32 | 6.8 |
| Product of Example C-2 | 1.6 |
| 100 Neutral Paraffinic Oil | remainder |
| Example XIV | |
| Product of Example B-32 | 4.5 |
| Product of Example C-1 | 1.4 |
| Product of Example D-22 | 1.4 |
| 100 Neutral Paraffinic Oil | remainder |
| Example XV | |
| Product of Example B-29 | 4.8 |
| Product of Example C-1 | 0.75 |
| Product of Example D-22 | 1.20 |
| Product of Example E-1 | 0.45 |
| Product of Example E-3 | 0.30 |
| 100 Neutral Paraffinic Oil | remainder |
| Example XVI | |
| Product of Example B-21 | 4.7 |
| Product of Example C-4 | 1.2 |
| Product of Example D-20 | 1.2 |
| Product of Example E-1 | 0.5 |
| Product of Example E-3 | 0.2 |
| 100 Neutral Paraffinic Oil | remainder |

The lubricating oil compositions of the present invention exhibit a reduced tendency to deteriorate under conditions of use and thereby reduce wear and the formation of such undesirable deposits as varnish, sludge, carbonaceous materials and resinous materials which tend to adhere to the various engine parts and reduce the efficiency of the engines. Lubricating oils also can be formulated in accordance with this invention which result in improved fuel economy when used in the crankcase of a passenger automobile. In one embodiment, lubricating oils can be formulated within this invention which can pass all of the tests required for classification as an SG oil. The lubricating oils of this invention are useful also in diesel engines, and lubricating oil formulations can be prepared in accordance with this invention which meet the requirements of the new diesel classification CE.

The performance characteristics of the lubricating oil compositions of the present invention are evaluated by subjecting lubricating oil compositions to a number of engine oil tests which have been designed to evaluate various performance characteristics of engine oils. As mentioned above, in order for a lubricating oil to be qualified for API Service Classification SG, the lubricating oils must pass certain specified engine oil tests.

The ASTM Sequence, IIIE engine oil test has been recently established as a means of defining the high-temperature wear, oil thickening,, and deposit protection capabilities of SG engine oils. The IIIE test, which replaces the Sequence IIID test, provides improved discrimination with respect to high temperature camshaft and lifter wear protection and oil thickening control. The IIIE test utilizes a Buick 3.8 L V-6 model engine which is operated on leaded fuel at 67.8 bhp and 3000 rpm for a maximum test length of 64 hours. A valve spring load of 230 pounds is used. A 100% glycol coolant is used because of the high engine operating temperatures. Coolant outlet temperature is maintained at 118° C., and the oil temperature is maintained at 149° C. at an oil pressure of 30 psi. The air-to-fuel ratio is 16.5, and the blow-by rate is 1.6 cfm. The initial oil charge is 146 ounces.

The test is terminated when the oil level reaches 28 ounces low at any of the 8-hour check intervals. When the tests are concluded before 64 hours because of low oil level, the low oil level has generally resulted from hang-up of the heavily oxidized oil throughout the engine and its inability to drain to the oil pan at the 49° C. oil check temperature. Viscosities are obtained on the 8-hour oil samples, and from this data, curves are plotted of percent viscosity increase versus engine hours. A maximum 375% viscosity increase measured at 40° C. at 64 hours is required for API classification SG. The engine sludge requirement is a minimum rating of 9.2, the piston varnish a minimum of 8.9, and the ring land deposit a minimum of 3.5 based on the CRC merit rating system. Details of the current Sequence IIIE Test are contained in the "Sequence IIID Surveillance Panel Report on Sequence III Test to the ASTM Oil Classification Panel", dated Nov. 30, 1987, revised Jan. 11, 1988.

The results of the Sequence IIIE test conducted on Lubricant VII are summarized in the following Table III.

TABLE III

| | ASTM Sequence III-E Test | | | | |
|---|---|---|---|---|---|
| | Test Results | | | | |
| Lubricant | % Vis Increase | Engine Sludge | Piston Varnish | Ring Land Deposit | VTW[a] Max/Ave |
| VII | 135 | 9.5 | 9.3 | 6.8 | 3/2 |

[a]In ten-thousandth of an inch.

The Ford Sequence VE test is described in the "Report of the ASTM Sludge and Wear Task Force and the Sequence VD Surveillance Panel—Proposed PV2 Test", dated Oct. 13, 1987.

The test uses a 2.3 liter (140 CID) 4-cylinder overhead cam engine equipped with a multi-point electronic fuel injection system, and the compression ratio is 9.5:1. The test procedure uses the same format as the Sequence VD test with a four-hour cycle consisting of three different stages. The oil temperatures (°F.) in Stages I, II and III are 155/210/115, and the water temperatures (°F.) in three stages are 125/185/115, respectively. The test oil charge volume is 106 oz., and the rocker cover is jacketed for control of upper engine temperature. The speeds and loads of the three stages have not been changed from the VD test. The blow-by rate in Stage I is increased to 2.00 CFM from 1.8 CFM, and the test length is 12 days. The PCV valves are replaced every 48 hours in this test.

At the end of the test, engine sludge, rocker cover sludge, piston varnish, average varnish and valve train wear are rated.

The results of the Ford Sequence VE test conducted on Lubricants VII, VIII and IX of the present invention are summarized in the following Table IV. The performance requirements for SG classification are as follows: engine sludge, 9.0 (min.); rocker cover sludge, 7.0 (min.); average varnish 5.0 (min.); piston varnish, 6.5 (min.); VTW, 15/5 (max.).

TABLE IV

| | Ford Sequence VE Test | | | | |
|---|---|---|---|---|---|
| | Test Results | | | | |
| Lubricant | Engine Sludge | Rocker Cover Sludge | Average Varnish | Piston Varnish | VTW[a] Max/Ave |
| VII | 9.4 | 9.2 | 5.0 | 6.9 | 1.6/1.3 |
| VIII | 9.4 | 9.2 | 5.8 | 6.7 | 0.9/0.74 |
| IX | 9.2 | 8.5 | 5.3 | 6.9 | 1.3/0.9 |

[a]In mils or thousandth of an inch.

The CRC L-38 test is a test developed by the Coordinating Research Council. This test method is used for determining the following characteristics of crankcase lubricating oils under high temperature operating conditions: antioxidation, corrosive tendency, sludge and varnish-producing tendency, and viscosity stability. The CLR engine features a fixed design, and is a single cylinder, liquid-cooled, spark-ignition engine operating at a fixed speed and fuel flow. The engine has a one-quart crankcase capacity. The procedure requires that the CLR single cylinder engine be operated at 3150 rpm, approximately 5 bhp, 290° F. oil gallery temperature and 200° F. coolant-out temperature for 40 hours. The test is stopped every 10 hours for oil sampling and topping up. The viscosities of these oil samples are determined, and these numbers are reported as part of the test result.

A special copper-lead test bearing is weighed before and after the test to determine the weight loss due to corrosion. After the test, the engine also is rated for sludge and varnish deposits, the most important of which is the piston skirt varnish. The primary performance criteria for API Service Classification SG are bearing weight loss, mg, max of 40 and a piston skirt varnish rating (minimum) of 9.0. The target for the 10-hour stripped viscosity is 12.5 to 16.3. When the L-38 test is conducted utilizing Lubricant VII described above, the bearing weight loss is 21.1 mg, the piston skirt varnish rating is 9.5, and the 10-hour stripped viscosity is 12.7.

The Oldsmobile Sequence IID test is used to evaluate the rusting and corrosion characteristics of motor oils. The test and test conditions are described in ASTM Special Technical Publication 315H (Part 1). The test relates to short trip service under winter driving conditions as encountered in the United States. The sequence IID uses an Oldsmobile 5.7 liter (350 CID) V-8 engine run under low speed (1500 rpm), low load conditions (25 bhp) for 28-hours with engine coolant-in at 41° C. and coolant-out at 43° C. Following this, the test operates for two hours at 1500 rpm with coolant-in at 47° C. and the coolant-out at 49° C. After a carburetor and spark plug change, the engine is operated for the final two hours under high-speed (3600 rpm), moderate load conditions (100 bhp) with coolant-in at 88° C. and the coolant-out at 93° C. Upon completion of the test (32 hours), the engine is inspected for rust using CRC rating techniques. The number of stuck valve lifters also is recorded which gives an indication of the magnitude of rust. The minimum average rust rating in order to pass the IID test is 8.5. When the lubricating oil composition identified above as Lubricant VII is subjected to the sequence IID test, the average CRC rust rating is 8.7.

The Caterpillar 1G2 Test described in ASTM Special Technical Publication 509A, Part I relates to heavy-duty diesel applications. The Caterpillar 1G2 Test is used for determining the effect of lubricating oils on ring-sticking, ring and cylinder wear and accumulation of piston deposit in a Caterpillar engine. The test involves the operation of the special super-charged, single-cylinder diesel test engine for a total of 480 hours at a fixed speed of 1800 rpm and fixed heat input. The heat input-high heat valve is 5850 btu/min, and the heat input-low heat valve is 5440 btu/min. The engine is run at 42 bhp. Water from the cylinder head is at about 88° C. and oil-to-bearings temperature is about 96° C. Inlet air-to-engine is maintained at about 124° C., and the exhaust temperature is about 594° C. The test oil is used as a lubricant, and the diesel fuel is conventionally refined diesel fuel containing 0.37 to 0.43 weight percent of natural sulfur.

Upon completion of the test, the diesel engine is examined to determine whether any stuck rings are present, the degree of cylinder, liner and piston ring wear, and the amount and nature of piston deposits present. In particular, the top groove filling (TGF), and the weighted total demerits (WTD) based on coverage and location of deposits are recorded as primary performance criteria of the diesel lubricants in this test. The target values for the 1G2 test are a TGF maximum of 80 (% by volume) and a maximum WTD rating of 300.

The results of the Caterpillar 1G2 test conducted on Lubricant VII of the present invention are summarized in the following Table V.

TABLE V

| | Caterpillar 1G2 Test | | |
|---|---|---|---|
| Lubricant | Hours | Top Groove Filing | Weighted Total Demerits |
| VII | 480 | 79 | 275 |

The advantages of the lubricant oil compositions of the present invention as diesel lubricants is demonstrated by subjecting the lubricants of Lubricant Examples IX–XI to the Mack Truck Technical Services Standard Test Procedure No. 5GT 57 entitled "Mack T-7: Diesel Engine Oil Viscosity Evaluation", dated Aug. 31, 1984. This test has been designed to correlate with field experience. In this test, a Mack EM6-285 engine is operated under low speed, high torque, steady-state conditions. The engine is a direct injection, in-line, six-cylinder, four-stroke, turbo-charged series charge air-cooled compression ignition engine containing keystone rings. The rated power is 283 bhp at 2300 rpm governed speed.

The test operation consists of an initial break-in period (after major rebuild only) a test oil flush, and 150 hours of steady state operation at 1200 rpm and 1080 ft/lb. of torque. No oil changes or additions are made, although eight 4 oz. oil samples are taken periodically from the oil pan drain valve during the test for analysis. Sixteen ounces of oil are taken at the oil pan drain valve before each 4 oz. sample is taken to purge the drain line. This purge sample is then returned to the engine after sampling. No make-up oil is added to the engine to replace the 4 oz. samples.

The kinematic viscosity at 210° F. is measured at 100 and 150 hours into the test, and the "rate of viscosity increase" is calculated. The rate of viscosity increase is defined as the difference between the 100-hour viscosity and the 150-hour viscosity divided by 50. It is desirable that this value should be below 0.04, reflecting a minimum viscosity increase as the test progresses.

The kinematic viscosity at 210° F. can be measured by two procedures. In both procedures, the sample is passed through a No. 200 sieve before it is loaded into the Cannon reverse flow viscometer. In the ASTM D-445 method, the viscometer is chosen to result in flow times equal to or greater than 200 seconds. In the method described in the Mack T-7 specification, a Cannon 300 viscometer is used for all viscosity determinations. Flow times for the latter procedure are typically 50–100 seconds for fully formulated 15W-40 diesel lubricants.

The results of the Mack T-7 test using three of the lubricants of the invention are summarized in the following table.

TABLE VI

| | Mack T-7 Results |
|---|---|
| Lubricant of Example | Rate of Viscosity Increase* |
| IX | 0.028 |
| X | 0.028 |
| XI | 0.036 |

*Centistokes per hour (100–150).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating oil composition for internal combustion engines which comprises
   (A) a major amount of oil of lubricating viscosity, and minor amounts of
   (B) at least one carboxylic derivative composition produced by reacting
      (B-1) at least one substituted succinic acylating agent with
      (B-2) from about 0.70 equivalent up to less than one equivalent, per equivalent of acylating agent, of at least one amine characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and
   (C) at least one metal salt of a dihydrocarbyl dithiophosphoric acid wherein
      (C-1) the dithiophosphoric acid is prepared by reacting phosphorus pentasulfide with an alcohol mixture comprising at least 10 mole percent of isopropyl alcohol and at least one primary aliphatic alcohol containing from about 3 to about 13 carbon atoms, and
      (C-2) the metal is a Group II metal, aluminum, tin, iron, cobalt, lead, molybdenum, manganese, nickel or copper.

2. The oil composition of claim 1 containing at least about 2% by weight of the carboxylic derivative composition (B).

3. The oil composition of claim 1 containing at least about 2.5% by weight of the carboxylic derivative composition (B).

4. The oil composition of claim 1 wherein the value of Mn in (B) is at least about 1500.

5. The oil composition of claim 1 wherein the value of $\overline{M}/\overline{M}$ in (B) is at least about 2.0.

6. The oil composition of claim 1 wherein the substituent groups in (B) are derived from one or more polyalkenes selected from the group consisting of homopolymers and interpolymers of terminal olefins of from 2 to about 6 carbon atoms with the proviso that said interpolymers can optionally contain up to about 25% of polymer units derived from internal olefins of up to about 6 carbon atoms.

7. The oil composition of claim 1 wherein the substituent groups in (B) are derived from a member selected from the group consisting of polybutene, ethylene-propylene copolymer, polypropylene, and mixtures of two or more of any of these.

8. The oil composition of claim 1 wherein the substituent groups in (B) are derived from polybutene in which at least about 50% of the total units derived from butenes is derived from isobutene.

9. The oil composition of claim 1 wherein in (B), from about 0.70 to about 0.95 equivalent of the amine (B-2) is reacted per equivalent of acylating agent (B-1).

10. The oil composition of claim 1 wherein the amine (B-2) is an aliphatic, cycloaliphatic or aromatic polyamine.

11. The oil composition of claim 1 wherein the amine (B-2) is a hydroxy-substituted monoamine, polyamine, or mixtures thereof.

12. The oil composition of claim 1 wherein the amine (B-2) is characterized by the general formula

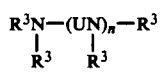

(VIII)

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

13. The oil composition of claim 1 wherein the primary aliphatic alcohol in (C-1) contains from about 6 to about 13 carbon atoms.

14. The oil composition of claim 1 wherein the metal of (C-2) is zinc, copper, or mixtures of zinc and copper.

15. The oil composition of claim 1 wherein the metal of (C-2) is zinc.

16. The oil composition of claim 1 wherein the alcohol mixture in (C-1) comprises at least 20 mole percent of isopropyl alcohol.

17. The oil composition of claim 1 also containing at least one additional metal salt of a dihydrocarbyl dithiophosphoric acid characterized by Formula IX

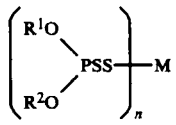

(IX)

wherein $R^1$ and $R^2$ are hydrocarbyl groups containing from 3 to about 10 carbon atoms, M is a Group I metal, a Group II metal, aluminum, tin, iron, cobalt, lead, molybdenum, manganese, nickel or copper, and n is an integer equal to the valence of M.

18. The oil composition of claim 17 wherein at least one of the hydrocarbyl groups in Formula IX is attached to the oxygen atom through a secondary carbon atom.

19. The oil composition of claim 17 wherein $R^1$ and $R^2$ in Formula IX are hydrocarbyl groups attached to the oxygen atoms through secondary carbon atoms.

20. The oil composition of claim 1 also containing (D) at least one carboxylic ester derivative composition produced by reacting (D-1) at least one substituted succinic acylating agent with (D-2) at least one alcohol of the general formula $$R^3(OH)_m \quad \text{(X)}$$

wherein $R^3$ is a monovalent or polyvalent organic group joined to the —OH groups through carbon bonds, and m is an integer of from 1 to about 10.

21. The oil composition of claim 20 wherein the substituted succinic acylating agent in (D-1) consists of substituent groups and succinic groups wherein the substituent groups have an $\overline{M}n$ of at least about 700.

22. The oil composition of claim 21 wherein the substituent groups in (D-1) are derived from a polyalkene having an Mn value of from about 700 to about 5000.

23. The oil composition of claim 20 wherein the alcohol (D-2) of Formula X is a monohydric or polyhydric alcohol containing up to 40 aliphatic carbon atoms.

24. The oil composition of claim 21 wherein the substituent groups in (D-1) are derived from a member selected from the group consisting of polybutene, ethylene-propylene copolymer, polypropylene, and mixtures of two or more of any of these.

25. The oil composition of claim 21 wherein the substituent groups in (D-1) are derived from polybutene in which at least about 50% of the total units derived from polybutenes are derived from isobutene.

26. The oil composition of claim 20 wherein the alcohol (D-2) is neopentyl glycol, ethylene glycol, glycerol, pentaerythritol, sorbitol, mono-alkyl or mono-aryl ethers of a poly(oxyalkylene) glycol, or mixtures of any one of these.

27. The oil composition of claim 20 wherein from about 0.1 to about 2 moles of alcohol (D-2) are reacted with one mole of the substituted succinic acylating agent (D-1).

28. The oil composition of claim 20 wherein m in Formula X is at least 2.

29. The oil composition of claim 20 wherein the carboxylic ester derivative composition (D) prepared by reacting the acylating agent (D-1) with the alcohol (D-2) is further reacted with (D-3) at least one amine containing at least one HN< group.

30. The oil composition of claim 29 wherein the amine (D-3) is a polyamine.

31. The oil composition of claim 30 wherein the polyamine (D-3) is an aliphatic, cycloaliphatic or aromatic polyamine.

32. The oil composition of claim 30 wherein the polyamine (D-3) is an alkylene polyamine.

33. The oil composition of claim 30 wherein the polyamine (D-3) is characterized by the general formula

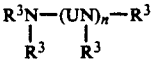

(VIII)

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

34. The oil composition of claim 20 wherein the substituted succinic acylating agent (D-1) consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of from about 1.5 to about 4.5, said acylating agents being characterized by the presence within their structure of at least about 1.3 succinic groups for each equivalent weight of substituent group.

35. The oil composition of claim 34 wherein the polyalkene in (D-1) is characterized as having an Mn value of at least about 1500 and an $\overline{M}w/\overline{M}n$ value of about 2 to about 4.

36. The oil composition of claim 34 wherein the carboxylic ester prepared by reacting the acylating agent with the alcohol is further reacted with (D-3) at least one amine containing at least one HN< group.

37. The oil composition of claim 36 wherein the amine (D-3) is a polyamine.

38. The oil composition of claim 37 wherein the polyamine (D-3) is an aliphatic, cycloaliphatic or aromatic polyamine.

39. The oil composition of claim 37 wherein the polyamine (D-3) is an alkylene polyamine.

40. The oil composition of claim 37 wherein the polyamine (D-3) is characterized by the general formula $$\begin{array}{c} R^3N-(UN)_n-R^3 \\ | \quad\quad | \\ R^3 \quad\; R^3 \end{array} \qquad \text{(VIII)}$$

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

41. The oil composition of claim 1 also containing (E) at least one neutral or basic alkaline earth metal salt of at least one acidic organic compound.

42. The oil composition of claim 41 wherein the acidic organic compound in (E) is a sulfur acid, carboxylic acid, phosphorus acid, phenol, or mixtures thereof.

43. The oil composition of claim 41 wherein the alkaline earth metal in (E) is calcium, magnesium, or mixtures of calcium and magnesium.

44. The oil composition of claim 41 wherein the alkaline earth metal salt (E) is a basic metal salt having a metal ratio of at least about 2.

45. The oil composition of claim 41 wherein the acidic compound in (E) is at least one organic sulfonic acid.

46. The oil composition of claim 45 wherein the organic sulfonic acid is a hydrocarbyl-substituted aromatic sulfonic acid, or an aliphatic sulfonic acid represented by Formulae XI and XII, respectively $$R_x-T-(SO_3H)_y \qquad \text{(XI)}$$

$$R'-(SO_3H)_r \qquad \text{(XII)}$$

wherein R and R' are each independently an aliphatic group containing up to about 60 carbon atoms, T is an aromatic hydrocarbon nucleus, x is a number of 1 to 3, and r and y are numbers of from 1 to 2.

47. The oil composition of claim 45 wherein the sulfonic acid is an alkylated benzene sulfonic acid.

48. The oil composition of claim 1 also containing (F) at least one partial fatty acid ester of a polyhydric alcohol.

49. The oil composition of claim 48 wherein the fatty acid ester of the polyhydric alcohol is a partial fatty acid ester of glycerol.

50. The oil composition of claim 48 wherein the fatty acid contains from about 10 to about 22 carbon atoms.

51. A lubricating oil composition for internal combustion engines which comprises (A) a major amount of oil of lubricating viscosity, (B) from about 0.5% to about 10% by weight of at least one carboxylic derivative composition produced by reacting (B-1) at least one substituted succinic acylating agent with (B-2) from about 0.70 equivalent to about 0.95 equivalent, per equivalent of acylating agent, of at least one amine characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 2 to about 4.5, said acylating agents being characterized by the presence within their structure of an average of at least 1.3 succinic groups for each equivalent weight of substituent groups, (C) from about 0.05 to about 5% by weight of at least one metal salt of a dihydrocarbyl dithiophosphoric acid wherein (C-1) the dithiophosphoric acid is prepared by reacting phosphorus pentasulfide with an alcohol mixture comprising at least 10 mole percent of isopropyl alcohol and at least one primary aliphatic alcohol containing from about 3 to about 13 carbon atoms, and (C-2) the metal is a Group II metal, aluminum, tin, iron, cobalt, lead, molybdenum, manganese, nickel or copper, (D) 0.1 to about 10% of at least one carboxylic ester derivative composition produced by reacting (D-1) at least one substituted succinic acylating agent with (D-2) at least one alcohol of the general formula $$R_3(OH)_m \qquad \text{(X)}$$

wherein $R^3$ is a monovalent or polyvalent organic group joined to the —OH groups through carbon bonds, and m is an integer of from 2 to about 10, and (E) from about 0.01 to about 5% by weight of at least one alkaline earth metal salt of an organic acid compound selected from the group consisting of sulfur acids, carboxylic acids, phosphorus acids, phenols, and mixtures of said acids.

52. The oil composition of claim 51 containing at least about 2.0% by weight of the carboxylic derivative composition (B).

53. The oil composition of claim 51 containing at least about 2.5% by weight of the carboxylic derivative composition (B).

54. The oil composition of claim 51 wherein the amine (B-2) is a polyamine characterized by the general formula $$R^3N-(UN)_n-R^3 \quad (VIII)$$
$$\quad\;\; | \qquad\;\; |$$
$$\quad R^3 \qquad R^3$$

wherein n is an integer from 1 to about 10, each $R^3$ is independently a hydrogen atom, a hydrocarbyl group or a hydroxy-substituted or an amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

55. The oil composition of claim 51 wherein the primary aliphatic alcohol in (C-1) contains from about 6 to about 13 carbon atoms.

56. The oil composition of claim 51 wherein the metal of (C-2) is zinc, copper, or mixtures of zinc and copper.

57. The oil composition of claim 51 wherein the metal of (C-2) is zinc.

58. The oil composition of claim 51 wherein the alcohol mixture in (C-1) comprises at least 20 mole percent of isopropyl alcohol.

59. The oil composition of claim 51 wherein the substituted succinic acylating agent (D-1) consists of substituent groups and succinic groups wherein the substituent groups have an $\overline{M}n$ value of at least about 700.

60. The oil composition of claim 59 wherein the substituent groups are derived from a polyalkene having an $\overline{M}n$ value of from about 700 to about 5000.

61. The oil composition of claim 51 wherein the alcohol (D-2) is a monohydric or polyhydric alcohol containing up to 40 aliphatic carbon atoms.

62. The oil composition of claim 59 wherein the substituent groups are derived from a member selected from the group consisting of polybutene, ethylene-propylene copolymer, polypropylene, and mixtures of two or more of any of these.

63. The oil composition of claim 59 wherein the substituent groups are derived from polybutene in which at least about 50% of the total units derived from polybutenes are derived from isobutene.

64. The oil composition of claim 51 wherein the alcohol (D-2) is neopentyl glycol, ethylene glycol, glycerol, pentaerythritol, sorbitol, mono-alkyl or monoaryl ethers of a poly(oxyalkylene) glycol, or mixtures of any two or more of these.

65. The oil composition of claim 51 wherein from about 0.1 to about 2 moles of alcohol (D-2) are reacted with one mole of the substituted succinic acylating agent (D-1).

66. The oil composition of claim 51 wherein m in in Formula X is at least 2.

67. The oil composition of claim 51 wherein the carboxylic ester of (D) is further reacted with (D-3) at least one polyamine containing at least one HN< group.

68. The oil composition of claim 67 wherein the amine (D-3) is at least one polyamine.

69. The oil composition of claim 68 wherein the polyamine (D-3) is an aliphatic, cycloaliphatic or aromatic polyamine.

70. The oil composition of claim 68 wherein the polyamine (D-3) is characterized by the general formula $$R^3N-(UN)_n-R^3 \quad (VIII)$$
$$\quad\;\; | \qquad\;\; |$$
$$\quad R^3 \qquad R^3$$

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

71. The oil composition of claim 51 wherein the substituted succinic acylating agent (D-1) reacted with the alcohol (D-2) consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of from about 1.5 to about 4.5, said acylating agents being characterized by the presence within their structure of at least about 1.3 succinic groups for each equivalent weight of substituent group.

72. The oil composition of claim 71 wherein the polyalkene is characterized as having an $\overline{M}n$ value of at least about 1500 and an $\overline{M}w/\overline{M}n$ value of about 2 to about 4.5.

73. The oil composition of claim 71 wherein the carboxylic ester derivative composition is further reacted with (D-3) at least one polyamine containing at least one HN< group.

74. The oil composition of claim 73 wherein the amine is a polyamine.

75. The oil composition of claim 74 wherein the polyamine is an aliphatic, cycloaliphatic or aromatic polyamine.

76. The oil composition of claim 74 wherein the polyamine is an alkylene polyamine.

77. The oil composition of claim 74 wherein the polyamine is characterized by the general formula $$R^3N-(UN)_n-R^3 \quad (VIII)$$
$$\quad\;\; | \qquad\;\; |$$
$$\quad R^3 \qquad R^3$$

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

78. The oil composition of claim 51 also containing (F) from about 0.01 to 2% by weight of at least one partial fatty acid ester of a polyhydric alcohol.

79. The oil composition of claim 78 wherein the polyhydric alcohol is glycerol.

80. The oil composition of claim 78 wherein the fatty acid contains from about 10 to about 22 carbon atoms.

81. A lubricating oil composition for internal combustion engines which comprises (A) a major amount of oil of lubricating viscosity, (B) from about 2% to about 10% by weight of at least one carboxylic derivative composition produced by reacting (B-1) at least one substituted succinic acylating agent with (B-2) from about 0.75 equivalent to about 0.90 equivalent, per equivalent of acylating agent, of at least one polyamine characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 2 to about 4, said acylating agents being characterized by the presence within their structure of an average of at least 1.3 succinic groups for each equivalent weight of substituent groups, (C) from about 0.05 to about 5% by weight of at least one metal salt of a dihydrocarbyl dithiophosphoric acid wherein (C-1) the dithiophosphoric acid is prepared by reacting phosphorus pentasulfide with an alcohol mixture comprising at least about 20 mole percent of isopropyl alcohol and at least one primary aliphatic alcohol containing from about 6 to about 13 carbon atoms, and (C-2) the metal is a Group II metal, aluminum, tin, iron, cobalt, lead, molybdenum, manganese, nickel or copper, (D) 0.1 to about 10% of at least one carboxylic ester derivative composition produced by reacting (D-1) at least one substituted succinic acylating agent with (D-2) from about 0.1 to about 2 moles, per mole of acylating agent of at least one polyhydroxy compound selected from the group consisting of neopentyl glycol, ethylene glycol glycerol, pentaerythritol, sorbitol, mono-alkyl or mono-aryl ethers of a poly(oxyalkylene)glycol or mixtures of any two or more of these, and (E) from about 0.01 to about 5% by weight of at least one alkaline earth metal salt of an organic acid compound selected from the group consisting of sulfonic acids, carboxylic acids, phenols, and mixtures of said acids.

82. The oil composition of claim 81 containing at least about 2.5% by weight of the carboxylic derivative composition (B).

83. The oil composition of claim 81 wherein the polyamine (B-2) is a polyamine characterized by the general formula $$\underset{\underset{R^3}{|}}{R^3N}-\underset{\underset{R^3}{|}}{(UN)_n}-R^3 \qquad \text{(VIII)}$$

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

84. The oil composition of claim 81 wherein the alcohol mixture in (C-1) comprises at least about 40 mole percent of isopropyl alcohol.

85. The oil composition of claim 81 wherein the metal of (C-2) is zinc.

86. The oil composition of claim 81 wherein the substituted succinic acylating agent (D-1) consists of substituent groups and succinic groups wherein the substituent groups have an Mn value of from about 700 to about 5000.

87. The oil composition of claim 86 wherein the substituent groups are derived from a member selected from the group consisting of polybutene, ethylene-propylene copolymer, polypropylene, and mixtures of two or more of any of these.

88. The oil composition of claim 86 wherein the substituent groups are derived from polybutene in which at least about 50% of the total units derived from polybutenes are derived from isobutene.

89. The oil composition of claim 81 wherein the carboxylic ester of (D) is further reacted with (D-3) at least one polyamine containing at least one HN< group.

90. The oil composition of claim 89 wherein the polyamine (D-3) is an aliphatic, cycloaliphatic or aromatic polyamine.

91. The oil composition of claim 89 wherein the polyamine (D-3) is characterized by the general formula $$\underset{\underset{R^3}{|}}{R^3N}-\underset{\underset{R^3}{|}}{(UN)_n}-R^3 \qquad \text{(VIII)}$$

wherein n is an integer from 1 to about 10, each $R^3$ is independently a hydrogen atom, a hydrocarbyl group or a hydroxy-substituted or amino-substituted hydrocarbyl group having up to about 30 atoms, or two $R^3$ groups on different nitrogen atoms can be joined together to form a U group with the proviso that at least one $R^3$ group is a hydrogen atom and U is an alkylene group of about 2 to about 10 carbon atoms.

92. The oil composition of claim 81 wherein the substituted succinic acylating agent (D-1) reacted with the polyhydroxy compound (D-2) consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of from about 1.5 to about 4, said acylating agents being characterized by the presence within their structure of at least about 1.3 succinic groups for each equivalent weight of substituent group.

93. The oil composition of claim 92 wherein the carboxylic ester derivative composition is further reacted with (D-3) at least one polyamine containing at least one HN< group.

94. The oil composition of claim 93 wherein the polyamine is an aliphatic, cycloaliphatic or aromatic polyamine.

95. The oil composition of claim 93 wherein the polyamine is an alkylene polyamine.

96. The oil composition of claim 81 also containing (F) from about 0.01 to 2% by weight of at least one partial fatty acid ester of a glycerol.

97. The oil composition of claim 96 wherein the fatty acid contains from about 10 to about 22 carbon atoms.

98. A concentrate for formulating lubricating oil compositions comprising from about 20 to about 90% by weight of a normally liquid, substantially inert organic diluent/solvent, (B) from about 10 to about 50% by weight of at least one carboxylic derivative composition produced by reacting (B-1) at least one substituted succinic acylating agent with (B-2) less than one equivalent, per equivalent of acylating agent, of at least one amine characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) from about 0.001 to about 15% by weight of at least one metal salt of a dihydrocarbyl dithiophosphoric acid wherein (C-1) the dithiophosphoric acid is prepared by reacting phosphorus pentasulfide with an alcohol mixture comprising at least 10 mole percent of isopropyl alcohol and at least one primary aliphatic alcohol containing from about 3 to about 13 carbon atoms, and (C-2) the metal is a Group II metal, aluminum, tin, iron, cobalt, lead, molybdenum, manganese, nickel or copper.

99. The concentrate of claim 98 also containing from about 1% by weight to about 30% by weight of (D) at least one carboxylic ester derivative composition produced by reacting (D-1) at least one substituted succinic acylating agent with (D-2) at least one alcohol of the general formula $$R^3(OH)_m \qquad (X)$$

wherein $R^3$ is a monovalent or polyvalent organic group joined to the —OH groups through carbon bonds, and m is an integer of from 1 to about 10.

100. The concentrate of claim 99 wherein the carboxylic ester (D) produced by reacting the acylating agent (D-1) with the alcohol (D-2) is further reacted with (D-3) at least one amine containing at least one HN< group.

101. The concentrate of claim 98 also containing from about 1% by weight to about 20% by weight of (E) at least one neutral or basic alkaline earth metal salt of at least one acidic organic compound.

102. The concentrate of claim 99 also containing from about 1% by weight of about 20% by weight of (E) at least one neutral or basic alkaline earth metal salt of at least one acidic organic compound.

103. The concentrate of claim 98 also containing from about 0.001% to about 10% by weight of (F) at least one partial fatty acid ester of a polyhydric alcohol.

104. The concentrate of claim 99 also containing from about 0.001% to about 10% by weight of (F) at least one partial fatty acid ester of a polyhydric alcohol.

105. The concentrate of claim 104 also containing from about 1% by weight to about 20% by weight of (E) at least one neutral or basic alkaline earth metal salt of at least one acidic organic compound.

* * * * *